US005790143A

United States Patent [19]

Takada et al.

[11] Patent Number: 5,790,143

[45] Date of Patent: Aug. 4, 1998

[54] IMAGE RECORDING APPARATUS FOR RECORDING IMAGES ON VARIOUS RECORDING MATERIAL AND A METHOD THEREFORE

[75] Inventors: Yoshihiro Takada, Kawasaki; Akio Suzuki, Yokohama, both of Japan

[73] Assignee: Canon Kabushiki Kaisha, Tokyo, Japan

[21] Appl. No.: 450,994

[22] Filed: May 25, 1995

[30] Foreign Application Priority Data

May 31, 1994 [JP] Japan ..... 6-119165

[51] Int. Cl.[6] ..... B41J 29/38

[52] U.S. Cl. ..... 347/16

[58] Field of Search ..... 347/12, 14, 16, 347/15, 105, 196, 193; 358/296, 298, 502, 506, 456, 459

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/10 |
| 4,463,359 | 7/1984 | Ayata et al. | 347/56 |
| 4,558,333 | 12/1985 | Sugitani et al. | 347/65 |
| 4,617,580 | 10/1986 | Miyakawa | 347/14 |
| 4,721,968 | 1/1988 | Arai et al. | 346/136 |
| 4,723,129 | 2/1988 | Endo et al. | 347/56 |
| 4,740,795 | 4/1988 | Endo et al. | 347/56 |
| 4,983,994 | 1/1991 | Mori et al. | 347/193 |
| 5,004,928 | 4/1991 | Suzuki et al. | 250/559 |
| 5,084,758 | 1/1992 | Danzuka et al. | 358/296 |
| 5,252,992 | 10/1993 | Fukushima et al. | 347/43 |
| 5,343,231 | 8/1994 | Suzuki | 347/14 |

FOREIGN PATENT DOCUMENTS

| | | |
|---|---|---|
| 59-123670 | 7/1984 | Japan . |
| 59-138461 | 8/1984 | Japan . |

*Primary Examiner*—Benjamin R. Fuller
*Assistant Examiner*—L. Anderson
*Attorney, Agent, or Firm*—Fitzpatrick, Cella, Harper & Scinto

[57] ABSTRACT

An image recording apparatus for recording high-quality images on various recording materials by setting optimum recording conditions in accordance with the types and applications of the recording materials has an operating unit for selecting a reflection and transmission mode for an OHP film. When the reflection mode is selected, a recording head is scanned once for recording an image for each recording width of the OHP film. When the transmission mode is selected, the recording head is scanned twice for recording an image for each recording width of the OHP film.

20 Claims, 17 Drawing Sheets

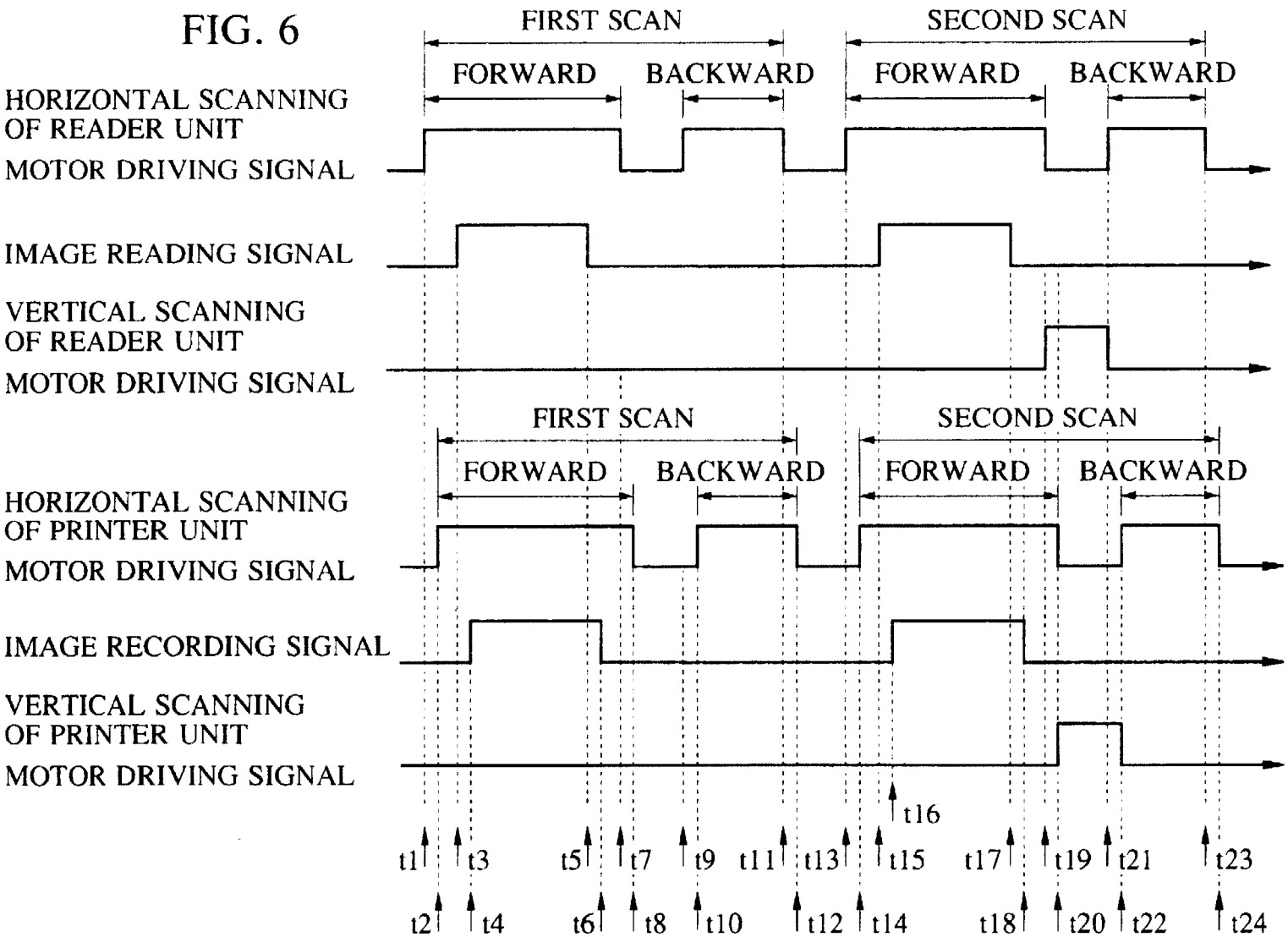
FIG. 6
HORIZONTAL SCANNING OF READER UNIT
MOTOR DRIVING SIGNAL
IMAGE READING SIGNAL
VERTICAL SCANNING OF READER UNIT
MOTOR DRIVING SIGNAL
HORIZONTAL SCANNING OF PRINTER UNIT
MOTOR DRIVING SIGNAL
IMAGE RECORDING SIGNAL
VERTICAL SCANNING OF PRINTER UNIT
MOTOR DRIVING SIGNAL
FIRST SCAN
FORWARD
BACKWARD
SECOND SCAN
FORWARD
BACKWARD
FIRST SCAN
FORWARD
BACKWARD
SECOND SCAN
FORWARD
BACKWARD
t1
t2
t3
t4
t5
t6
t7
t8
t9
t10
t11
t12
t13
t14
t15
t16
t17
t18
t19
t20
t21
t22
t23
t24

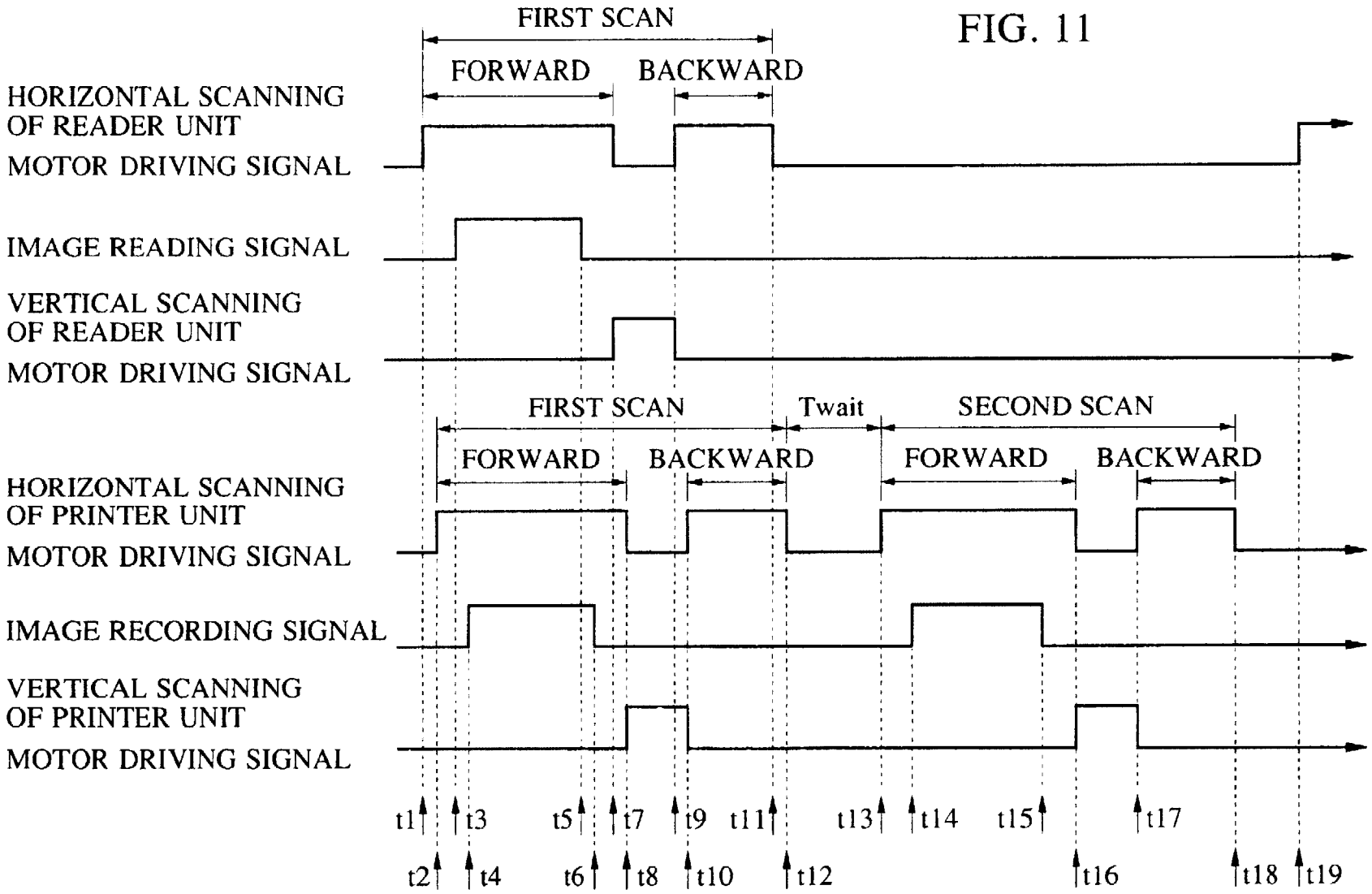
FIG. 11
FIRST SCAN
FORWARD
BACKWARD
SECOND SCAN
FORWARD
BACKWARD
Twait
FIRST SCAN
FORWARD
BACKWARD
HORIZONTAL SCANNING OF READER UNIT
MOTOR DRIVING SIGNAL
IMAGE READING SIGNAL
VERTICAL SCANNING OF READER UNIT
MOTOR DRIVING SIGNAL
HORIZONTAL SCANNING OF PRINTER UNIT
MOTOR DRIVING SIGNAL
IMAGE RECORDING SIGNAL
VERTICAL SCANNING OF PRINTER UNIT
MOTOR DRIVING SIGNAL
t1
t2
t3
t4
t5
t6
t7
t8
t9
t10
t11
t12
t13
t14
t15
t16
t17
t18
t19

IMAGE RECORDING APPARATUS FOR RECORDING IMAGES ON VARIOUS RECORDING MATERIAL AND A METHOD THEREFORE

BACKGROUND OF THE INVENTION

1. Field of the Invention

The present invention relates to an image recording apparatus which is capable of recording images on various recording materials such as transparent or semitransparent sheets for overhead projectors. Particularly, the present invention relates to an image recording apparatus suitable for use in an ink jet recording system in which recording is performed by discharging and scattering ink droplets as a recording liquid from a discharge opening, and adhering the droplets to a recording material.

2. Description of the Related Art

Known systems for recording images on recording materials include various recording systems such as a heat transfer recording system, a heat sensitive recording system, an ink jet recording system, etc.

The ink jet recording system of these recording systems, in which ink is discharged to a recording material in accordance with a recording signal, exhibits low running cost and is widely used as a silent recording system. Since this system uses a recording head having many nozzles which are arranged on a straight line perpendicular to the direction of relative movement of the recording material and the recording head, an image having a width corresponding to the number of the nozzles can be recorded at a time by one relative scan of the recording head and the recording material, thereby relatively easily achieving high-speed recording.

Examples of recording materials other than ordinary paper on which images are recorded by such an ink jet recording system include coated paper with low transparency, an OHP (Over Head Projector) transparent film (referred to as "OHP film" hereinafter), etc. The former coated paper comprises base paper and a dispersion mixture which contains silica or calcium carbonate as a filler dispersed in a binder comprising PVA (polyvinyl alcohol) or oxidized starch, and which is coated on the base paper for rapidly absorbing the ink droplets discharged from an ink-jet recording head. On the other hand, the latter OHP film comprises a transparent film such as a PET (polyethylene terephthalate) film, and a water absorbing resin such as PVA or ultrafine particles of silica or alumina having a particle size of several tens to several hundreds Å, which are coated on the transparent film to form an ink absorbing layer on the surface thereof.

Particularly, when a color image is recorded on the OHP film by the ink-jet recording system, a brilliant color recorded image exhibiting good light transmittance and high chroma can be obtained. Thus, a demand for OHP films has recently increased.

OHP films for ink jet recording are required to have the ink absorption property that the ink recorded on the surfaces thereof is rapidly absorbed without flowing or bleeding of ink, and many characteristics such as high recording density, sufficient density gradation, excellent color clearness and color reproducibility in color recording, and excellent record storage properties such as water resistance, light resistance, interior storage properties and frictional resistance. Particularly, a layer is coated on the surface of an OHP film for preventing ink from flowing or bleeding due to an insufficient amount of the ink being absorbed by the surface of the OHP film and an insufficient speed of ink absorption. Therefore, the thickness of the layer coated on the surface of the OHP film is several μm to about 50 μm. In particular, for OHP films for pictorial full-color recording, it is preferable to set the thickness of the coated layer to a higher value because many ink droplets are discharged.

However, when the layer coated on an OHP film is thickened, as described above, it is difficult to form the coated layer on the film such as a PET film or the like by with one coating. A plurality of coating steps are thus required, and the amount of the required coating material is increased, thereby increasing the production cost of the OHP film and deteriorating the transparency of the OHP film itself. This causes the problem that when the image recorded on the OHP film is projected by an over head projector, the quality of the projected image also deteriorates.

Thus, the layer coated on an OHP film is generally formed so as to have a thickness which can maintain a limit amount $Q_{max}$ (pl/mm$^2$) of recording ink, as shown in FIG. 12. FIG. 12 shows the amount of recording ink per unit area against input image signal S. As shown in FIG. 12, when the input image signal is maximum, the amount Q of recording ink is set to $Q_1$ (pl/mm$^2$). Namely, the thickness of the coated layer of the OHP film is set so as to prevent the occurrence of flowing or bleeding of ink even if recording ink droplets are recorded on the surface of the OHP film by an ink-jet recording head, i.e., so as to secure ink absorption capacity Q (pl/mm$^2$) for maintaining the limit amount $Q_{max}$ (pl/mm$^2$) of recording ink which prevents flowing of ink even if the maximum amount $Q_1$ (pl/mm$^2$) of recording ink is recorded by a recording head ($Q_1<Q_{max}$), thereby decreasing the cost of the OHP film itself.

As described above, the amount Q of recording ink changes with the image signal S input to a recording apparatus. $Q_1$ represents the maximum amount of recording ink for one recording scan, and $Q_{max}$ represents the limit amount of recording ink for one recording scan. As shown in FIG. 13, with a maximum recording density, a sufficient recording density $D_1$ on the OHP film can be attained, and the OHP film exhibits sufficient transparency when subjected to projection by an overhead projector.

When an image is recorded, by an ink-jet recording head, on such an OHP film having the surface provided with an ink absorption layer having a thickness which prevents flowing or bleeding of ink, and then projected by a reflection type overhead projector, a sufficient recording density is obtained. However, when the image is projected by a transmission type overhead projector, the density of the recorded image projected is lower than that of the image projected by the reflection type projector, thereby causing the problem that a satisfactory projected image cannot be obtained.

In the reflection type overhead projector, projection is performed by employing light reflected from an original base having high reflectance, i.e., projection is performed by light emitted from a light source, transmitted through the OHP film placed on the original base, reflected from the original base, and then transmitted through the OHP film again.

In the transmission type overhead projector, projection is performed by light emitted from a light source and transmitted trough an original base having high transmittance and through an OHP film.

SUMMARY OF THE INVENTION

An object of the present invention is to provide an image recording apparatus which is capable of recording high-quality images on various recording materials by setting optimum recording conditions in accordance with the type and application of the recording material used.

Another object of the present invention is to provide an image recording apparatus and a recording method which are capable of recording an image on an OHP film by setting conditions of recording on the OHP film in accordance with the type of the overhead projector used so that a high-quality projected image can be obtained.

In order to achieve the objects, in accordance with one aspect of the invention, there is provided an image recording apparatus comprising recording means for recording an image on a recording material on the basis of image data, movement means for moving the recording means relatively to the recording material, and recording control means which can change the number of recording operations within the same recording area of the recording material by the recording means.

In accordance with another aspect of the invention, there is provided a recording method in an image recording apparatus comprising recording means for recording an image on a recording material on the basis of image data, the recording method comprising the recording control step which can change the number of recording operations within the same recording area of the recording material by the recording means, and the recording step of recording by moving the recording means relatively to the recording material on the basis of the recording control step.

In accordance with a further aspect of the invention, there is provided an image recording apparatus comprising recording means for recording an image on a recording material on the basis of image data, the recording means recording an image in accordance with the recorded image density indicated by the image data; control means capable of changing the recorded image density indicated by the image data by controlling the recording means, and recording control means capable of changing the number of recording operations within the same recording area of the recording material by the recording means.

In accordance with a still further aspect of the invention, there is provided an image recording apparatus comprising recording means for recording an image on a recording material on the basis of image data; a first recording mode for recording on a recording material used for projection using transmitted light, which is suitable for a projection device having a relatively high projection density; a second recording mode for recording on a recording material used for projection using transmitted light, which is suitable for a projection device having a relatively low projection density; and recording control means capable of changing the recorded image density obtained by the recording means in accordance with the first and second recording modes.

The present invention can record high-quality images on various types of recording materials used for various applications, such as a recording material used for a reflection or transmission type overhead projector, in accordance with the type and application of the recording material used.

BRIEF DESCRIPTION OF THE DRAWINGS

FIGS. 5, 6 and 7 are timing charts illustrating examples of recording operations;

FIG. 11 is a timing chart illustrating an example of recording operations;

DESCRIPTION OF THE PREFERRED EMBODIMENTS

Embodiments of the present invention are described in detail below with reference to the drawings.

First Embodiment

Figure 1:
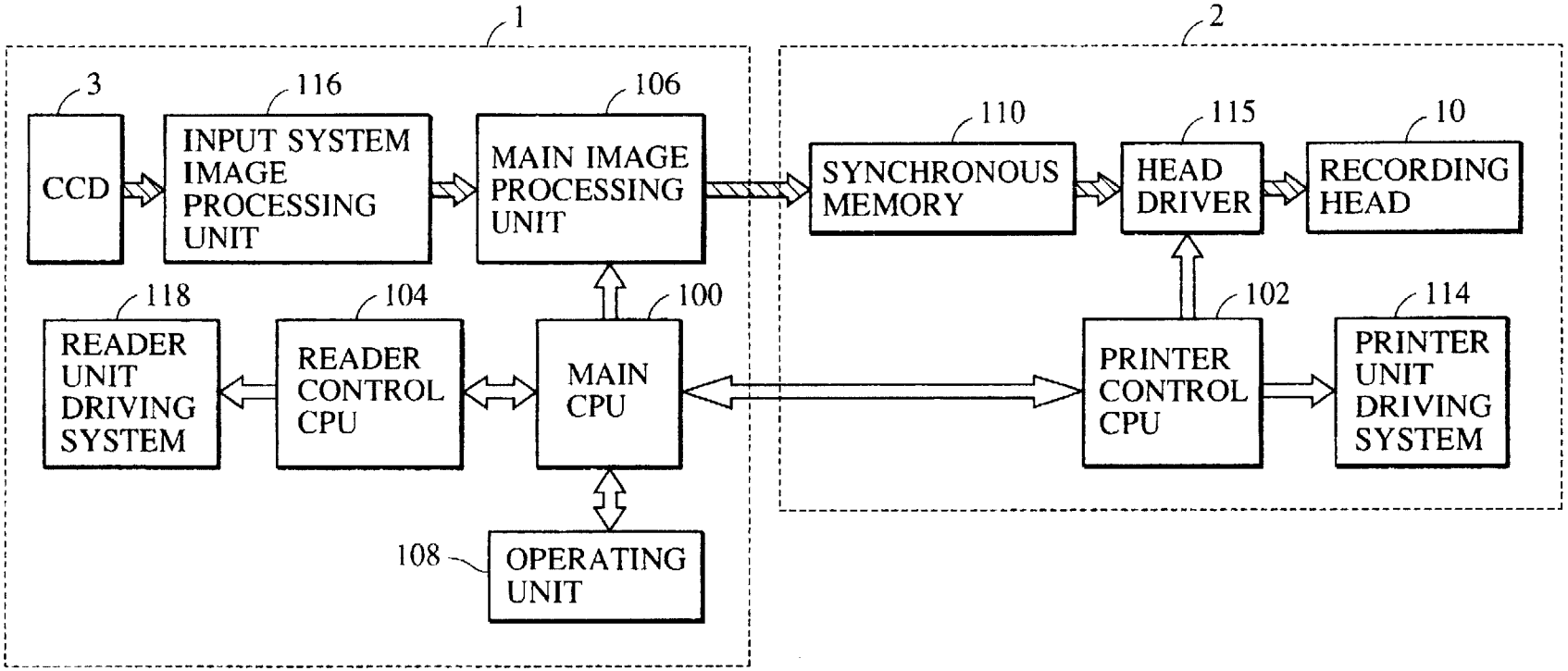
FIG. 1 is a block diagram illustrating an embodiment of the present invention.

FIG. 1 is a schematic block diagram illustrating the whole image recording apparatus in accordance with this embodiment. The image recording apparatus of this embodiment comprises a color image scanner unit (referred to as "a reader unit" hereinafter) 1 for reading a color image on an original and outputting digital color image data, and a printer unit 2 for recording a color image on a recording material on the basis of the digital color image data output from the reader unit 1.

In the reader unit 1, an image on the original placed on a glass plate of an original base is read for a length corresponding to the length of a CCD sensor, which corresponds to the width of recording by the recording head 10 below, by an exposure lamp and a lens, which are not shown in the drawing, and an image sensor 3 (in this embodiment, a CCD sensor) capable of reading a full-color line image. The serial scanning operation of the image sensor 3 and the operation of the whole apparatus are controlled by a main CPU 100. To the main CPU 100 are connected a printer control CPU 102 for controlling the printer unit 2, a reader control CPU 104 for controlling the reading operation, a main image processing unit 106 for processing an image, and an operating unit 108 serving as an input unit for the operator. One of reflection and transmission modes is selected by the operating unit 108 for recording an image on an OHP film, as described below.

The main image processing unit 106 performs image processing such as masking, black extraction, multi-value, γ-correction, etc. Synchronous memory 110 is connected to the printer control CPU 102 and the main image processing unit 106. The synchronous memory 110 is adapted for absorbing time irregularity of the input operation and correcting the delay caused by the mechanism arrangement of the recording head 10. The output from the synchronous memory 110 is input to the recording head 10 from a head driver 115 controlled by the printer control CPU 102.

The printer control CPU 102 is connected to a printer unit driving system 114 for controlling input driving of the printer unit 2.

The reader control CPU 104 is connected to an input system image processing unit 116 for correction processing required for the reading system, such as shading correction, color correction, γ-correction, etc. and a reader unit driving system 118 for controlling input driving of the reader.

The CCD sensor 3 is connected to the input system image processing unit 116 which is connected to the main image processing unit 106.

Figure 2:
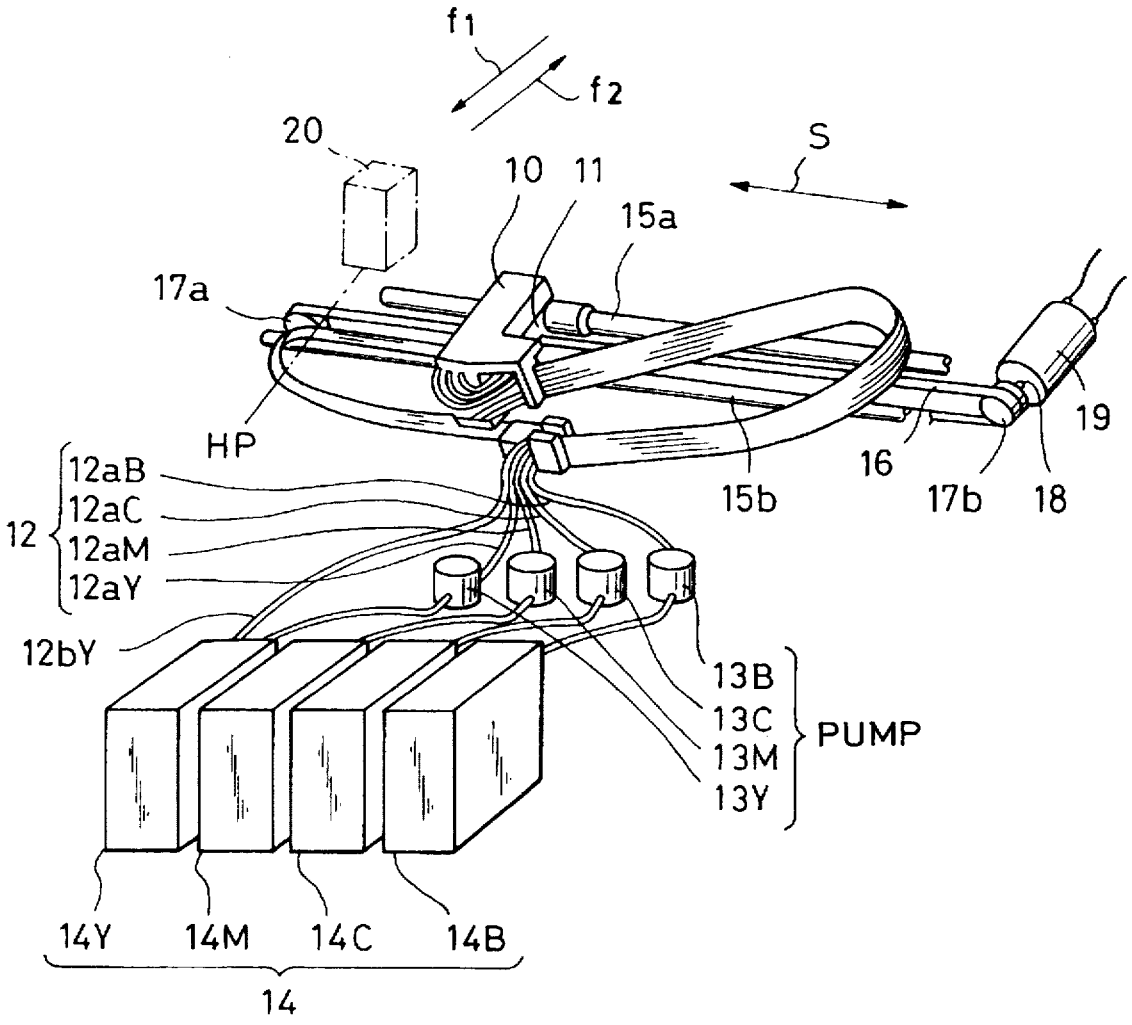
FIG. 2 is a schematic perspective view of the recording head shown in FIG. 1.

FIG. 2 is a perspective view illustrating the printer unit 2. The printer unit 2 roughly comprises two guide rails 15*a* and 15*b*, the ink jet recording head 10, a carriage 11 for loading the recording head 10 thereon, an ink supply device, a head recovery device 20 and an electrical system. When the carriage 11 is serially scanned by reciprocation in the direction of arrow S, an image for the recording width of the recording head 10 is recorded on a recording material at each scan.

The ink supply device is adapted for storing ink and supplying a necessary amount of ink to the head 10, and has ink tanks 14 and ink pumps 13. The apparatus and the head 10 are connected by ink supply tubes 12 so that ink is automatically supplied to the head 10 by the capillary phenomenon in an amount of discharge from the head 10. In the operation of recovering the head, as described below, ink is supplied to the head by the ink pumps 13. Reference numerals 12*a*B, 13B and 14B denote a tube, a pump, and a tank for black ink, respectively; and reference numerals 12*a*C, 13C and 14C, reference numerals 12*a*M, 13M and 14M and reference numerals 12*a*Y, 13Y and 14Y denote tubes, pumps, and tanks for cyan ink, magenta ink, and yellow ink, respectively.

The head 10 and the ink supply device are loaded on the head carriage 11 and an ink carriage, respectively. To both carriages is connected a belt which is provided between pulleys 17*a* and 17*b*, and a shaft 18 of a motor 19 is connected to the pulley 17*b* so that the carriages are reciprocated in the direction of arrow S (horizontal scanning direction) along the guide rails 15*a* and 15*b*.

The head recovery device 20 is provided opposite to the head 10 at the home position H for maintaining the stability of the head 10. Examples of the recovery operations of the head recovery device 10 include the operation of capping the head 10 at the home position H by moving the head 10 forward in the direction of arrow $f_1$ in order to prevent evaporation of ink from nozzles of the head 10 when printing is not performed, and the pressure recovery operation of forcing the ink to discharge from the nozzles by pressing an ink passage in the head 10 using the ink pumps during capping in order to discharge bubbles and dust at the front of the nozzles before the start of recording of an image. The head recovery device 20 also has the function to recover the ink discharged by the pressure recovery operation.

Figure 3:
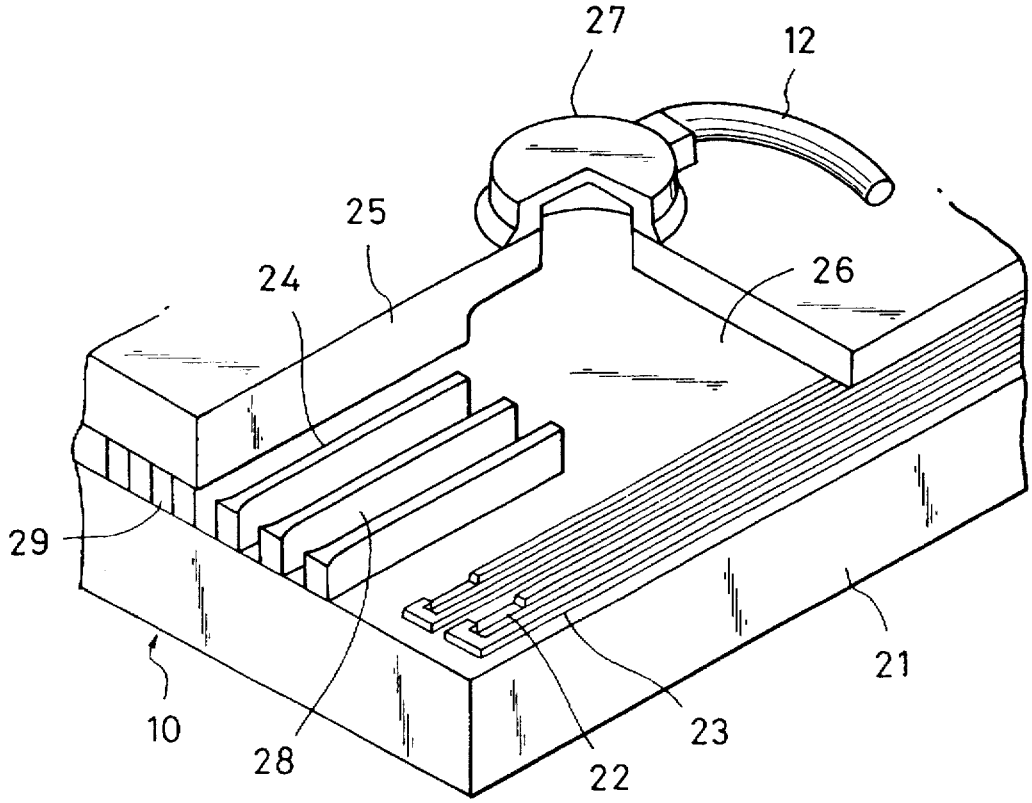
FIG. 3 is an exploded perspective view of a principal portion of the recording head shown in FIG. 2.

FIG. 3 is a perspective view illustrating the schematic configuration of the ink jet recording head 10. The head 10 comprises an electro-thermal converter 22, an electrode 23, nozzle walls 24 and a top plate 25, which are formed on a substrate 21 through semiconductor manufacturing processes such as etching, evaporation, sputtering, etc. Recording ink is supplied to a common chamber 26 of the recording head 10 from the ink tanks 14 through the ink supply tubes 12. In FIG. 3, reference numeral 27 denotes a supply tube connector. The ink supplied to the common chamber 26 is supplied to the ink passages 28 which form the nozzles, by the capillary phenomenon, and forms meniscuses on a discharge opening surface 29 to be stably held at the nozzle tip.

When electricity is passed through the electro-thermal converter 22 through the electrode 23, the ink on the surface of the electro-thermal converter 22 is heated, and foaming occur in the ink, thereby discharging ink droplets from the discharge opening surface 29 by foaming energy.

The above configuration permits the production of a multi-nozzle ink jet recording head having 128 nozzles or 256 nozzles in a high-density nozzle arrangement with a nozzle density of 16 nozzles/mm.

Figure 4:
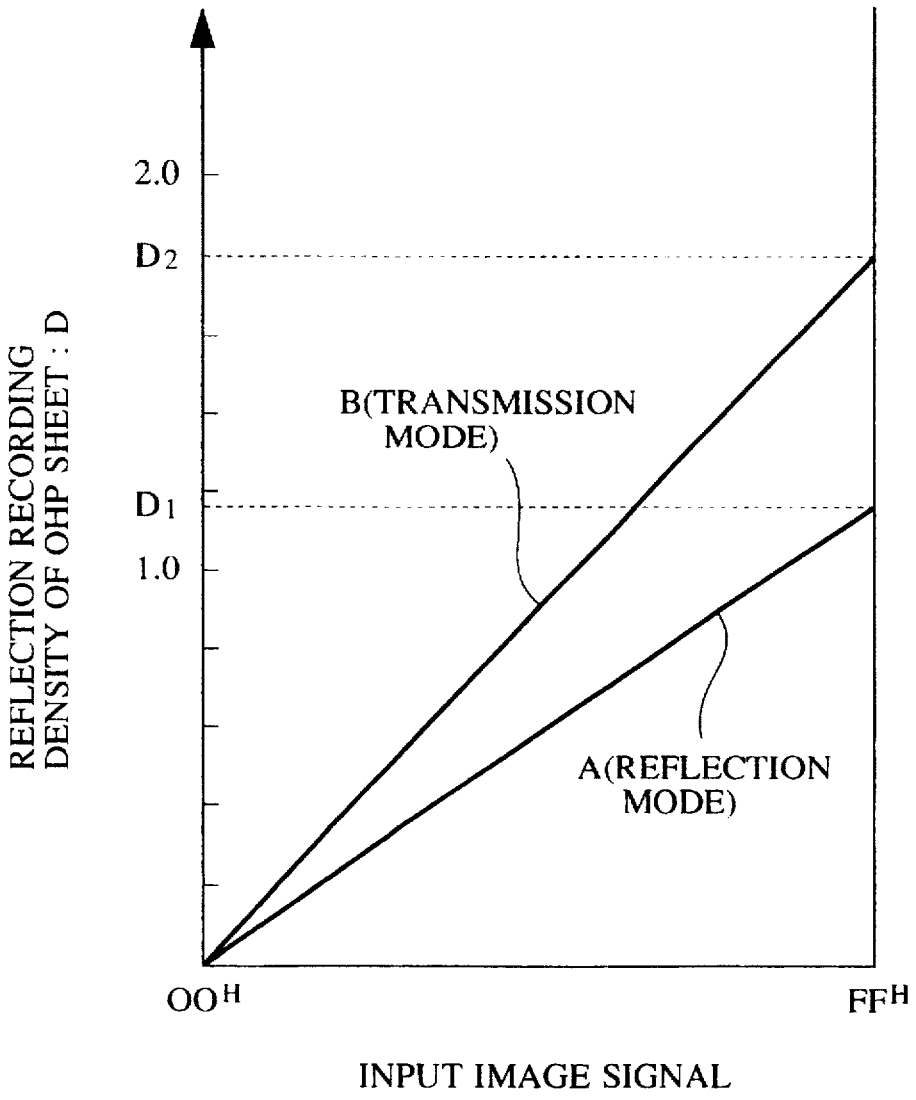
FIG. 4 is a drawing illustrating the relation between the number of recording operations and the recording density in a first embodiment of the present invention.

FIG. 4 is a drawing illustrating a difference in recording density between reflection and transmission modes, which will be described below, for recording on an OHP film suitable for ink jet recording by using the image recording apparatus of this embodiment. The reflection mode is a recording mode suitable for a reflection type overhead projector, and the transmission mode is a recording mode suitable for a transmission type overhead projector. The density of the image recorded on the OHP film by the recording head 10 changes with the input image signal. In FIG. 4, character A shows density changes with the image signal in the reflection mode, and character B shows density changes with the image signal in the transmission mode.

The reflection type overhead projector projects an image recorded on the OHP film by using light transmitted through the OHP film, reflected from an original base having high reflectance, and then transmitted through the OHP film again. The transmission type overhead projector projects an image recorded on the OHP film by using light emitted from a light source, and transmitted through an original base having high transmittance and the OHP film placed on the original base. Since the reflection type overhead projector employs light which is transmitted through the OHP film twice, the density of the image projected by the reflection type overhead projector is higher than that of the image projected by the transmission type overhead projector. In the present invention, therefore, in the transmission mode for forming an image suitable for the transmission type overhead projector, an image is recorded so that the maximum recording density $D_2$ in the transmission mode is higher than the maximum recording density $D_1$ in the reflection mode. This enables recording an image on an OHP film which exhibits a sufficient projection image density when the image is projected by the transmission type overhead projector.

Figure 5:
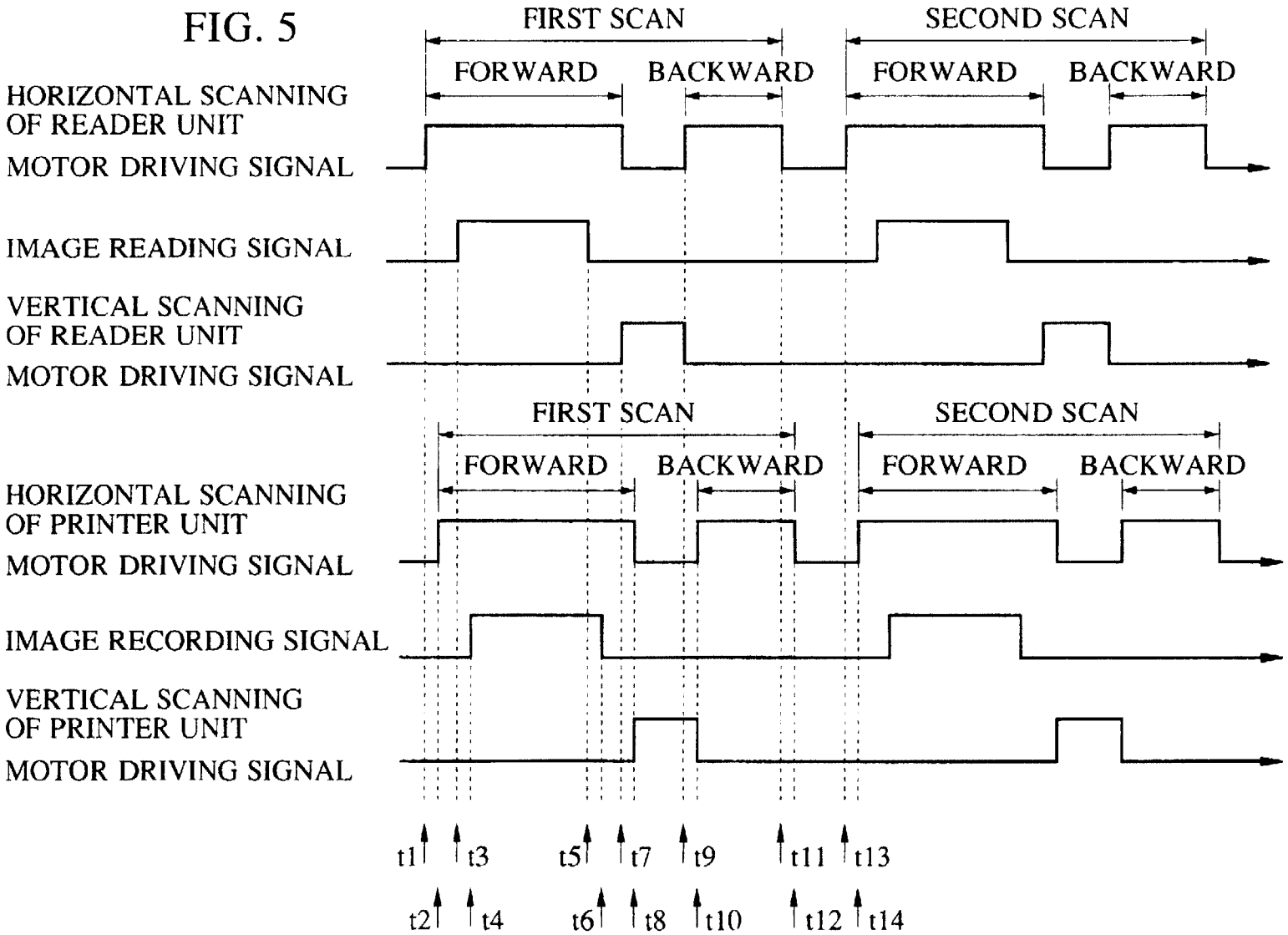

FIGS. 5 and 6 are timing charts for explaining the recording operations of this embodiment. In this embodiment, when an image is recorded on an OHP film, the reflection mode or transmission mode is selected by the operating unit 108, and control contents of the serial scanning operation of reading an image by the reader unit 1 and serial scanning operation of recording an image by the printer unit 2 are switched in accordance with the selected mode. Namely, when an image is recorded on the OHP film in the reflection mode, an image for the recording width of the recording head 10 is recorded on the OHP film by one serial scanning operation of each of the reader unit 1 and the printer unit 2, as shown in FIG. 5. On the other hand, in the transmission mode, an image for the recording width of the recording head 10 is recorded on the OHP film by two serial scanning operations of each of the reader unit 1 and the printer unit 2, as shown in FIG. 6, and recording ink droplets corresponding to the same image data are consequently discharged and superposed a plurality of times (in this embodiment, twice). The recording operation in each of the modes is described in detail below. This embodiment employs a one-direction recording system in which recording is performed only during movement of the printer unit 2 in the forward direction.

(Recording operation in reflection mode)

When an image is recorded on an OHP film in the reflection mode, an original image is read and recorded by serial scans of the reader section 1 and the printer section 2, respectively, in one-to-one correspondence.

Description will be made with reference to FIG. 5. When the scanning operation of the reader unit 1 in the forward direction is started at time $t_1$, forward movement of the printer unit 2 is started at time $t_2$. The operation of reading the original image by the CCD sensor mounted on the reader unit 1 is started at time $t_3$, and the operation of recording the image on the OHP film by the recording head 10 mounted on the printer unit 2 is then started at time $t_4$.

The delay time between time $t_1$ of the start of the scanning operation of the reader unit 1 and time $t_3$ of the start of the reading operation of the CCD sensor 3 is determined by the acceleration period of the scanning operation in an early stage. This is true of the recording operation.

When the operation of reading the original image by the CCD sensor 3 is completed at time $t_5$, the operation of recording the image by the recording head 10 is completed at time $t_6$, and the forward scanning operation of the reader unit 2 is stopped at time $t_7$. The reader unit 1 and the original are then relatively moved for a next reading width of the image in the vertical scanning direction by a vertical scanning motor of the reader unit 1. At the same time, the forward movement of the printer 2 is stopped at time $t_8$, and the printer unit 2 and the OHP film are then relatively moved for a next image recording width in the vertical scanning direction by a vertical scanning motor of the printer unit 2.

When the relative movement of the reader unit 1 and the original in the vertical scanning direction is completed at time $t_9$, the backward movement of the reader unit 1, i.e., back scanning operation, is the started. Similarly, after the relative movement of the printer unit 2 and the OHP film in the vertical scanning direction is completed at time $t_{10}$, the backward movement of the printer unit 2, i.e., the back scanning operation, is started. During these back scanning operations, the reader unit 1 does not read the original image, and the printer unit 2 does not record the image.

The back scanning operations of the reader unit 1 and the printer unit 2 are completed in turn at times $t_{11}$ and $t_{12}$, and the image reading operation and the image recording operation are completed by first reciprocating scans (referred to as "first scanning" hereinafter) of the reader unit 1 and the printer unit 2, respectively.

The image reading operation and the image recording operation by second scans of the reader unit 1 and the printer unit 2 are then started at times $t_{13}$ and $t_{14}$, respectively, in the same manner as the first scans, and the same operations as described above are repeated to completely recording the image on the OHP film.

In this embodiment, after the relative movement of the reader unit 1 and the original is completed, backward movement of the reader unit 1 is started. However, when horizontal scanning and vertical scanning can be individually performed, both movements may be simultaneously made. Similarly, vertical scanning and backward movement of the printer unit 2 may be simultaneously made for achieving high-speed reading and recording operations.

(Recording operation in transmission mode)

When an image is recorded on an OHP film in the transmission mode, as shown in FIG. 6, in first scans, the relative movement of the reader unit 1 and the original in the vertical scanning direction and relative movement of the printer unit 2 and the OHP film in the vertical scanning direction are not performed, and the image reading operation and image recording operation by the reader unit 1 and the printer unit 2 are repeated twice for the same recording width.

Namely, like in the above reflection mode, the first scanning operations of the reader unit 1 and the printer unit 2 in the forward direction are started at times $t_1$ and $t_2$, respectively. After the first scanning operations of the reader unit 1 and the printer unit 2 are completed at times $t_{11}$ and $t_{12}$, respectively, the back scanning operations of the reader unit 1 and the printer unit 2 are started without the operations of respectively moving the reader unit 1 and the printer unit 2 for the image reading width and image recording within the vertical scanning direction thereof. The image reading operation and image recording operation by the second scans of the reader unit 1 and the printer unit 2 are then started again at times $t_{15}$ and $t_{16}$, respectively. This causes the same image to be superposed and recorded twice on the OHP film within one recording width. The image reading operation and image recording operation by the second scans of the reader unit 1 and the printer unit 2 are then finished at times $t_{17}$ and $t_{18}$, respectively. After the forward scanning operations of the reader unit 1 and the printer unit 2 are finished at times $t_{19}$ and $t_{20}$, respectively, the operations of moving the reader unit 1 and the printer unit 2 for the image reading width and the image recording width in the vertical scanning direction are respectively started by vertical scanning motors. When the operations of moving the reader unit 1 and the printer unit 2 in the vertical scanning direction are finished at timing $t_{21}$ and $t_{22}$, back scanning operations are started. When the back scanning operations are finished at times $t_{23}$ and $t_{24}$, respectively, the image reading operation and image recording operation by the second scans of the reader unit 1 and the printer unit 2 are finished.

As described above, when an image is recorded on the OHP film, one of the reflection mode and the transmission mode is selected. In the transmission mode, the operations of moving the reader unit 1 and the printer unit 2 in the vertical scanning direction are performed once in a plurality of scanning operations (in this embodiment, every two scanning operations) in the horizontal scanning direction, and thus images for the same image reading width are superposed and recorded a plurality of times (in this embodiment, twice), thereby increasing the total amount of recording ink per unit areas of the OHP film. As a result, the OHP film exhibiting a sufficient projected image density even in projection by the transmission type OHP projector can be formed.

In this embodiment, although the density of the image recorded in the reflection mode is the same as recording on ordinary coated paper used for ink jet recording, the density of the image projected by an overhead projector appears to be lower than the apparent density of an image on the recording material. The recording density on the OHP film may thus be higher than the recording density on a recording material such as coated paper, which is not used for projection. In this case, the image density may be controlled by the main image processing unit 106.

Second Embodiment

Figure 7:
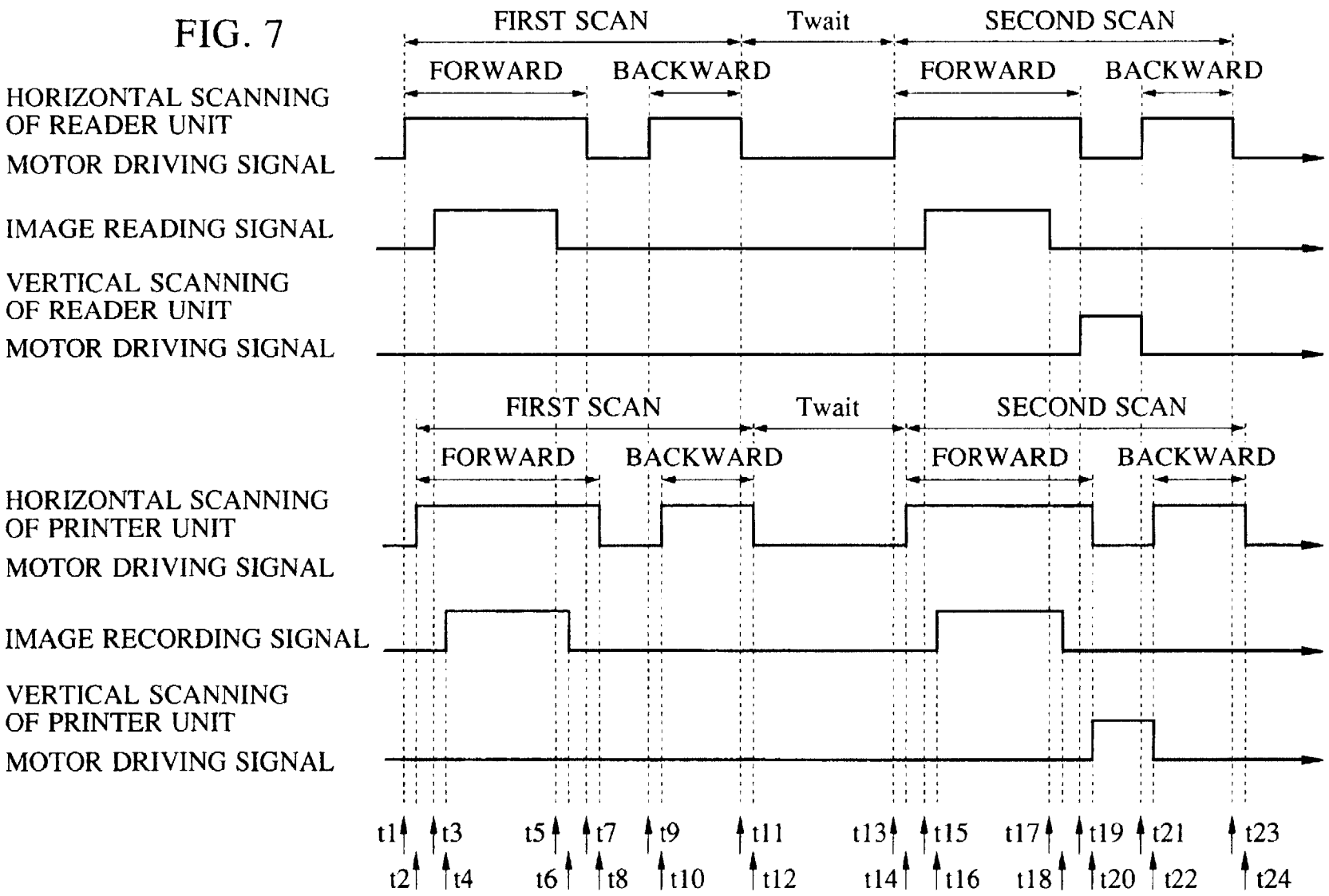

FIG. 7 is a timing chart for explaining the recording operation of an image recording apparatus in accordance with a second embodiment of the present invention. In this embodiment, when an image is recorded on an OHP film in the transmission mode, images corresponding to the same image data are superposed and recorded a plurality of times (in this embodiment, twice) within a recording width on the OHP film, and a predetermined waiting time (stop time) $T_{wait}$ is provided between the first image recording operation and the start of the second image recording operation.

FIG. 7 shows a timing chart in the transmission mode in this embodiment, the reflection mode being the same as the first embodiment.

In this embodiment, in the transmission mode, after the first scanning operations of the reader unit 1 and the printer unit 2 are finished at times $t_{11}$ and $t_{12}$, respectively, second scans for the same image reading operation and image recording operation as the first scans are started again at times $t_{13}$ and $t_{14}$, respectively, after the passage of the waiting time $T_{wait}$ in which ink droplets adhered to the OHP film in the first scans are sufficiently absorbed by the OHP film.

During the stop time, capping or recovery processing may be made by the recovery device 20 in order to prevent drying of the recording head 10 and adhesion of dust thereto.

When the waiting time $T_{wait}$ is provided between the first and second image recording operations by the printer unit 2, as in this embodiment, it is possible to prevent the flowing or bleeding of ink caused by insufficient absorption of ink droplets on the surface of the OHP film during second image recording.

Third Embodiment

Figure 8:
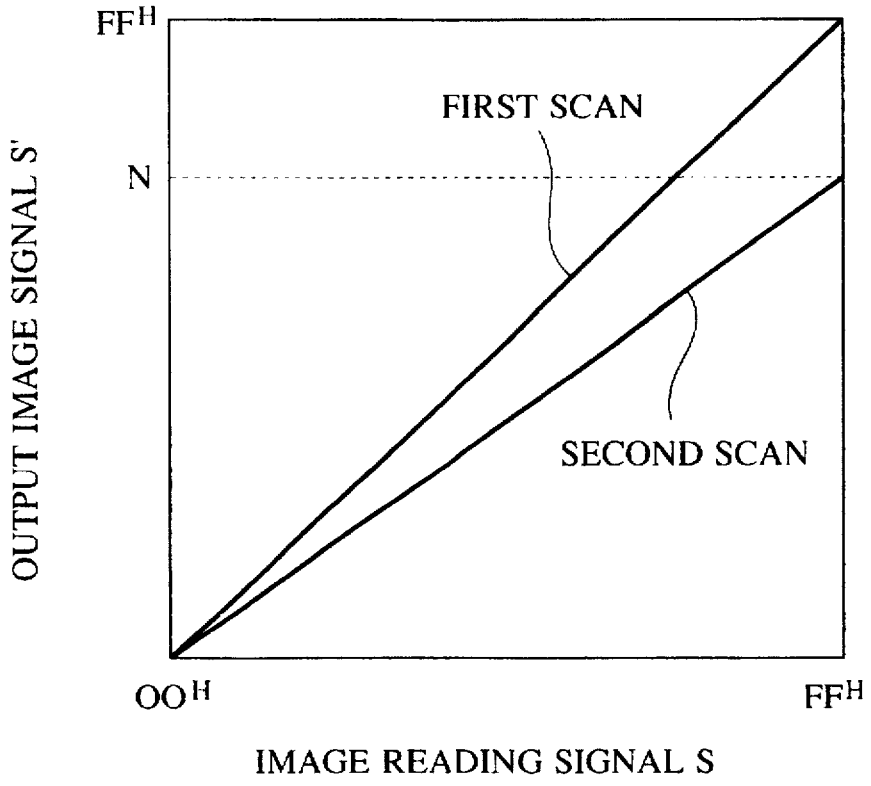
FIG. 8 is a drawing illustrating a switching table in an embodiment of the present invention.
Figure 9:
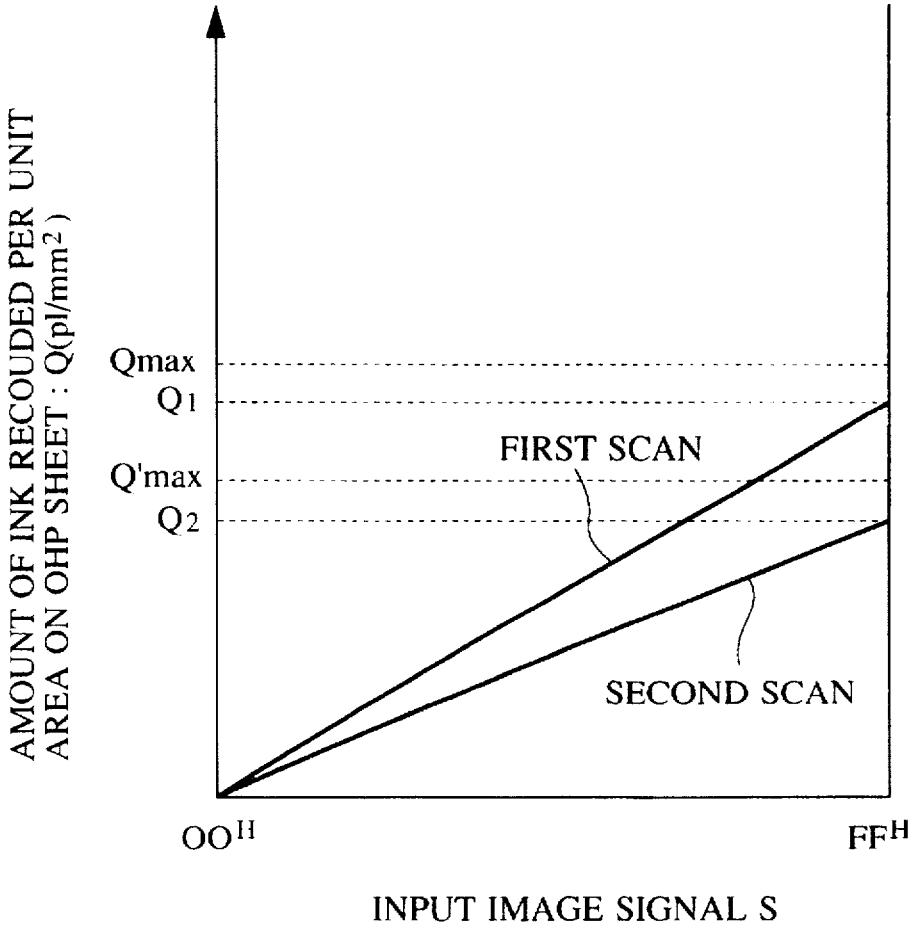
FIG. 9 is a drawing illustrating the relation between the number of recording operations and the recording density in an embodiment of the present invention.

FIGS. 8 and 9 are drawings for explaining an image recording apparatus in accordance with a third embodiment of the present invention.

In the above embodiments, when an image is recorded on an OHP film in the transmission mode, the images read by the reader 1 are superposed and recorded a plurality of times (in the embodiments, twice) on the OHP film. In this embodiment, in recording in the transmission mode, when an image is superposed and recorded on the OHP film by the second image recording operation after the first image recording operation, the value of the image signal S' output to the printer unit 2 corresponding to the image reading signal S of the reader unit 1 during the second image recording operation is lower than the signal in the first recording operation, as shown in FIG. 8. This decreases the amount of the ink adhered to the OHP film by the second image recording operation. The operation of switching signals in the first and second image recording operations, as shown in FIG. 8, is performed by using tables provided in the main image processing unit 106 shown in FIG. 1.

As shown in FIG. 9, for an OHP film having poor ink absorption, the limit amount $Q_{max}$ (pl/mm$^2$) of recording ink in an area where recording has not been performed yet, i.e., the limit ink amount of the OHP film in the first scan for the recording operation, is greater than the limit amount $Q'_{max}$ (pl/mm$^2$) of recording ink in an area where recording has already been performed, i.e., the limit amount of recording ink on the OHP film in the second scan for the recording operation ($Q_{max}>Q'_{max}$) It is preferable for such an OHP film that the maximum recording ink amount $Q_2$ (pl/mm$^2$) in the second scan by the recording head is smaller than the maximum amount $Q_1$ (pl/mm$^2$) of recording ink in the first scan ($Q_1>Q_2$).

In this embodiment, for an image (an image recorded in the second image recording operation) to be later superposed and recorded on the OHP film, the value of the output image signal S' as a recording condition is decreased for decreasing the amount of the ink discharged onto the OHP film. It is thus possible to record a high-quality image with a high density even on an OHP film having poor ink absorption without producing flowing or bleeding of ink on the surface thereof.

Fourth Embodiment

Figure 10:
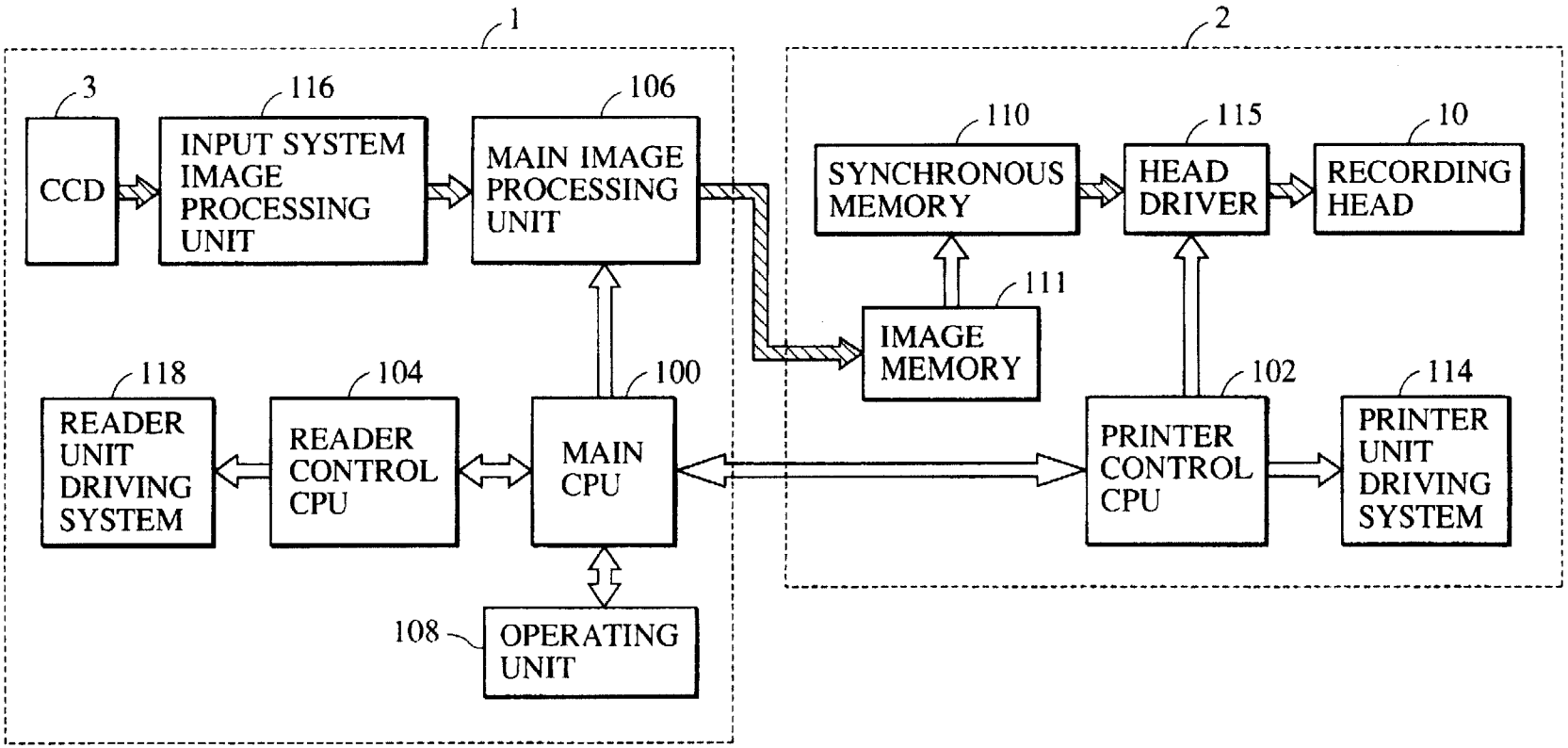
FIG. 10 is a block diagram illustrating an embodiment of the present invention.
Figure 12:
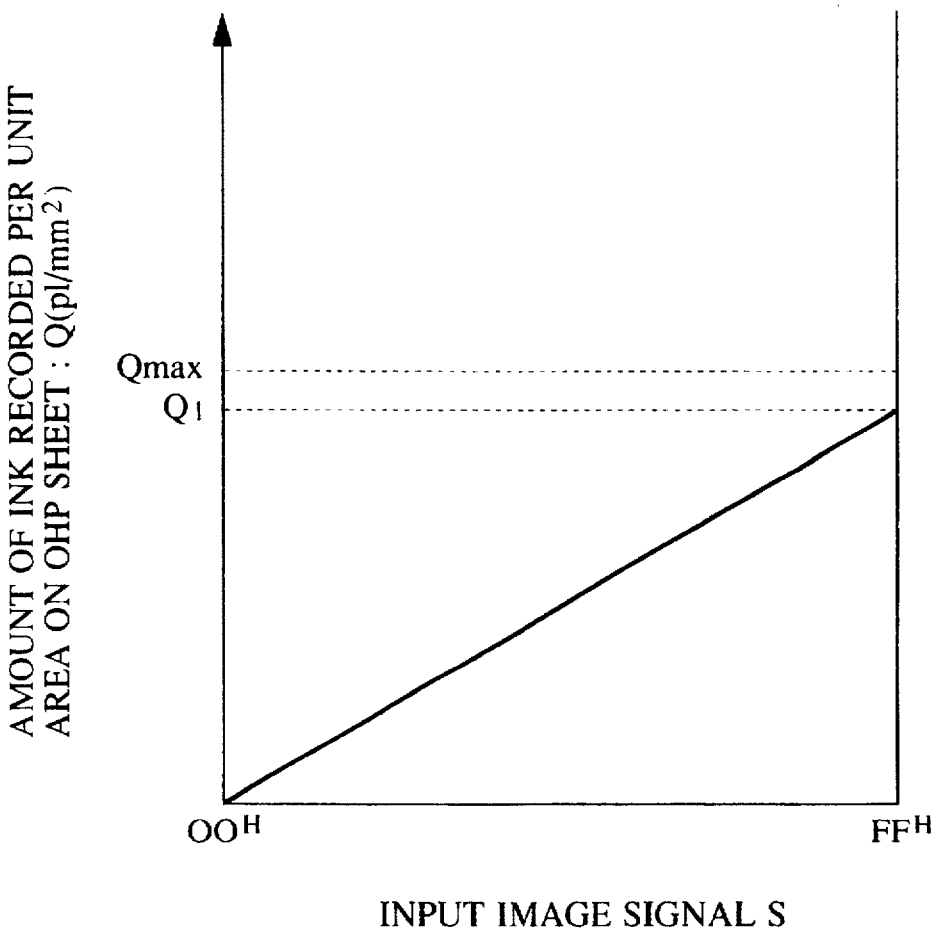
FIG. 12 is a drawing illustrating the ink absorption capacity of an OHP sheet.
Figure 13:
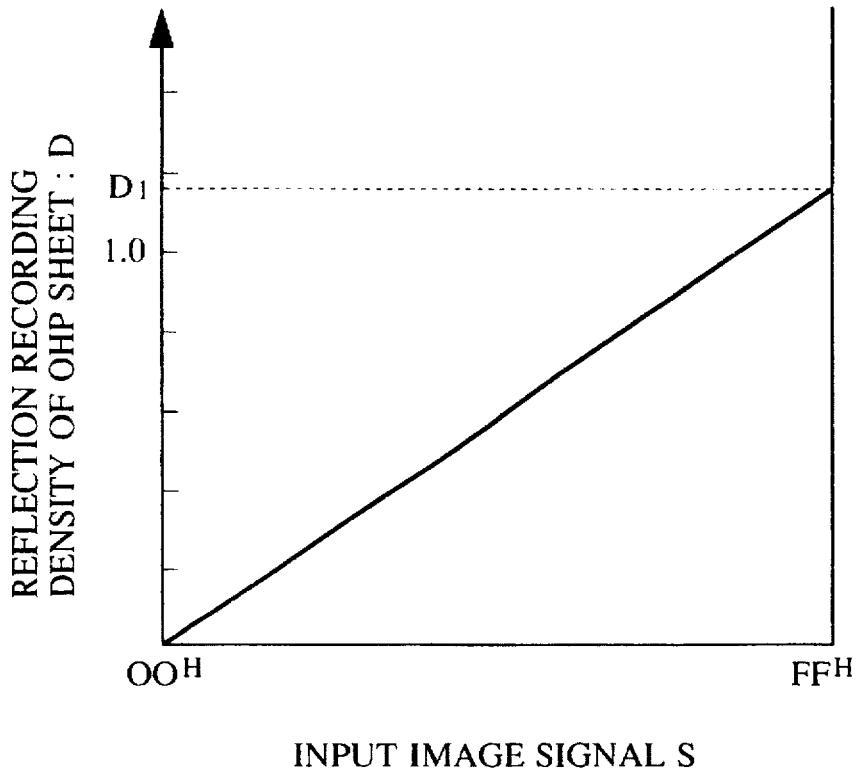
FIG. 13 is a drawing illustrating the relation between the image signal and the recording density.

FIG. 10 is a schematic block diagram illustrating an image recording apparatus in accordance with a fourth embodiment of the present invention. In the above embodiments, in the transmission mode, each of the image reading operation and recording operation is performed twice for the same area. However, in this embodiment, the original image data read by the reader unit 1 is stored in image memory 111 serving as storage means, and the printer control CPU 102 and the head driver 115 are controlled by the main CPU 100 so that the image data stored in the image memory 111 is recorded on an OHP sheet by the printer unit 2.

Namely, the image data for one scan which is read by the reader unit 1, i.e., the image data for the image reading width, is stored in the image memory 111, and repeatedly recorded by the printer unit 2. Only one scanning operation of the reader unit 1 is sufficient for the two scanning operations of the printer unit 2. It is consequently possible to prevent the occurrence of the problem in repeated reading of the same area of the original by the reader unit 1, i.e., the deterioration in quality of the recorded image caused by positional shift of the read pixel, and improve the durability of the exposure lamp and movable portion of the reader unit 1.

FIG. 11 is a timing chart illustrating the recording operation of this embodiment. After the image reading operation and image recording operation in first scans of the reader unit 1 and the printer unit 2 are finished at times $t_{11}$ and $t_{12}$, respectively, a waiting time $T_{wait}$ is provided for allowing ink to be absorbed into the OHP film, as the second embodiment. After the ink droplets adhered to the OHP film in the first scan are sufficiently absorbed into the OHP film within the waiting time $T_{wait}$ the second image recording operation by the printer unit 2 is started at time $t_{13}$. The operation of recording the image data stored in the image memory 111, i.e., the image data read by the first image reading operation by the reader unit 1, is started at time $t_{14}$.

After the image recording operation by the printer unit 2 is completed at time $t_{15}$, and after the forward scanning operation of the printer unit 2 is completed at time $t_{16}$, the conveyance of the printer unit 2 in the vertical scanning direction is started. After the conveyance of the printer unit 2 in the vertical scanning direction is completed at time $t_{17}$, the back scanning operation in the backward direction is started. After the back scanning operation in the backward direction is finished at time $t_{18}$, the image reading operation for a next image reading width by the reader unit 1 is started at time $t_{19}$.

Fifth Embodiment

Figure 14:
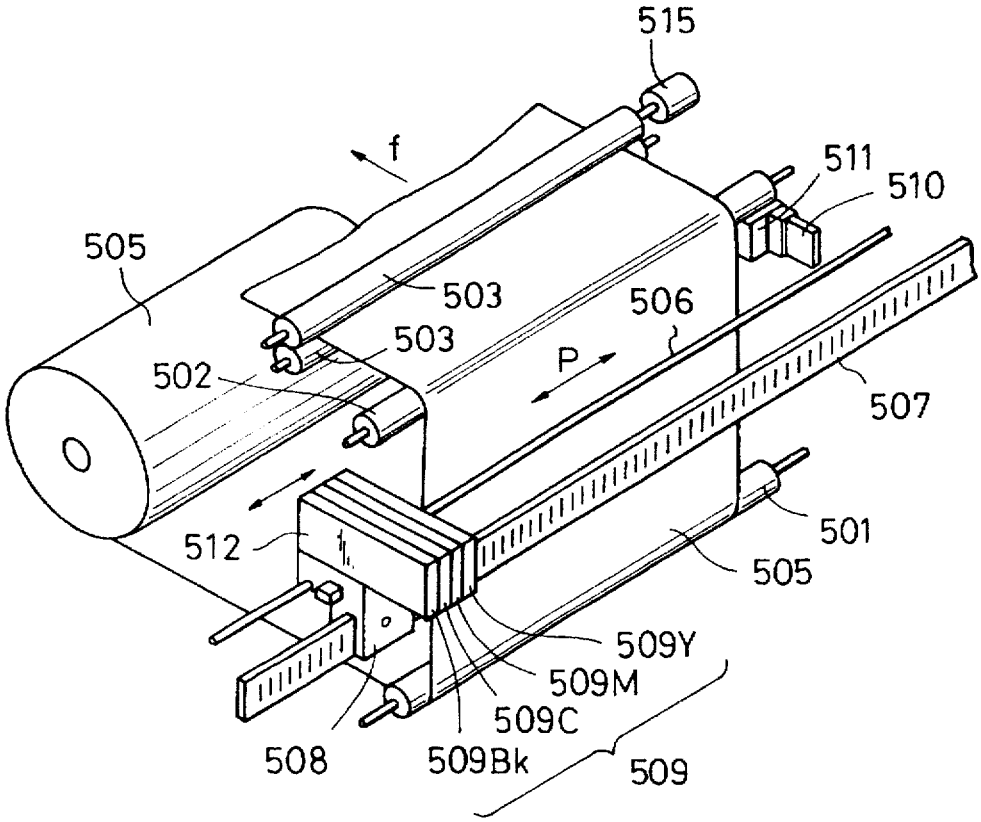
FIG. 14 is a perspective view illustrating the schematic configuration of an embodiment of the present invention.
Figure 15:
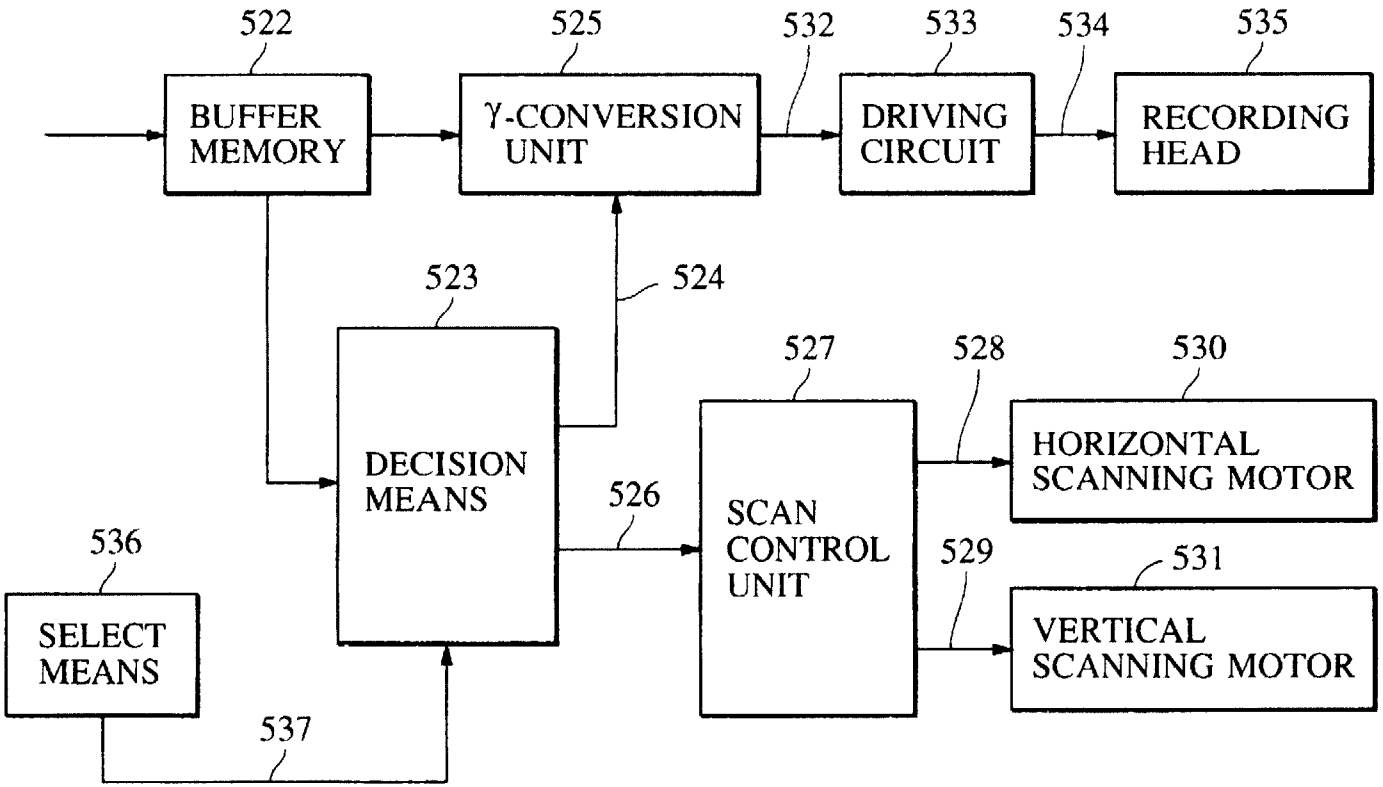
FIG. 15 is a block diagram illustrating an embodiment of the present invention.
Figure 16:
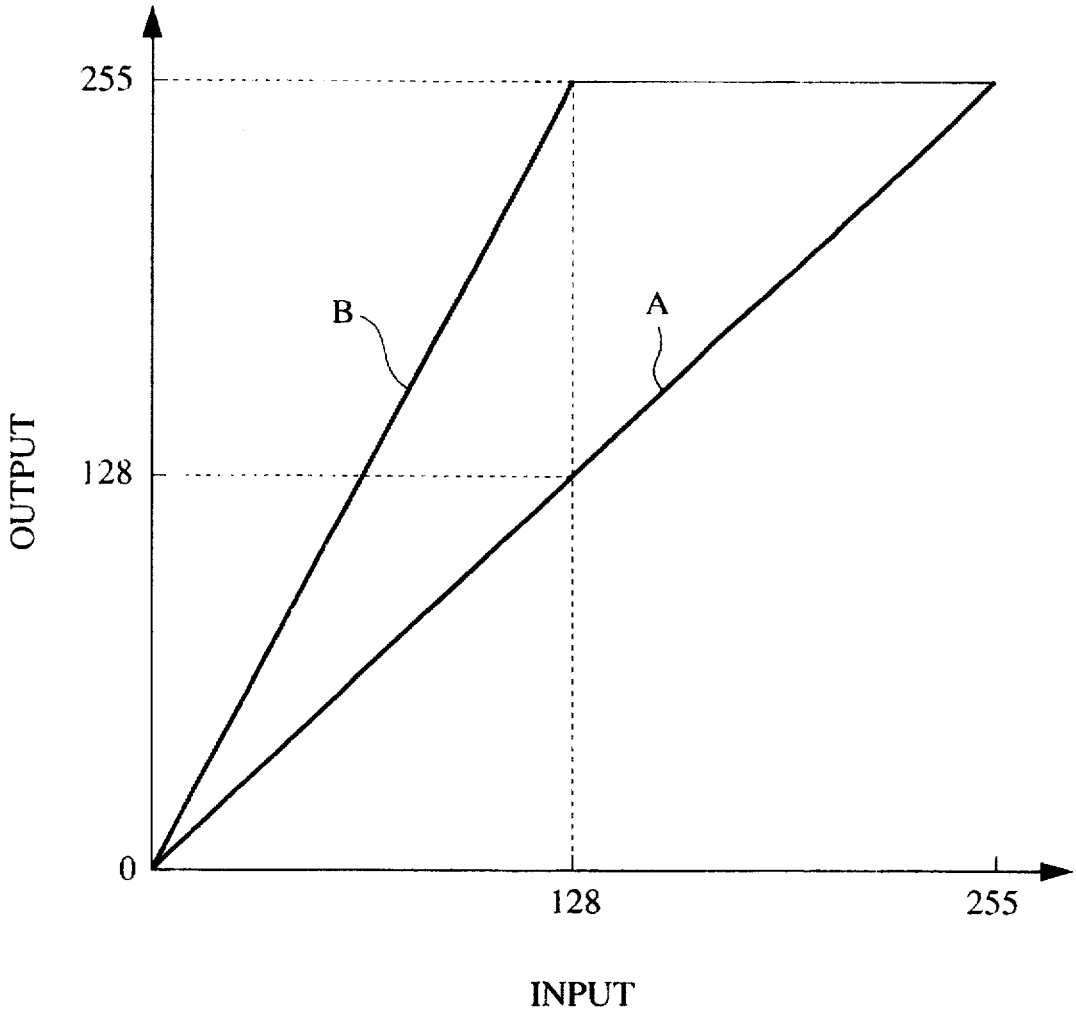
FIGS. 16 and 17 are drawings illustrating switching tables in an embodiment of the present invention.

FIGS. 14, 15 and 16 are drawings illustrating a fifth embodiment of the present invention.

FIG. 14 is a perspective view schematically showing an example of the configuration of an ink jet recording apparatus to which the present invention is applied. In FIG. 14, an OHP film (referred to as "a recording material" hereinafter) 505 which is wound in a roll is passed through conveyance rollers 501 and 502, held between a pair of feed rollers 503 and fed in the direction of arrow f with driving of a vertical scanning motor 515 which is connected to the pair of feed rollers 503. Guide rails 506 and 507 are disposed in parallel with each other in the transverse direction of the recording material 505, and a horizontal scanning carriage 508 is supported so as to be reciprocatable in the transverse direction along the guide rails 506 and 507. On the carriage 508 are mounted a plurality (four) of recording heads 509Y, 509M, 509C and 509Bk. In color recording, these recording heads are set so as to record with, for example, yellow, magenta, cyan and black color inks. In the description below, when all or any one of the recording heads 509Y, 509M, 509C and 509Bk is specified, the recording head is indicated by a recording means 509 or recording head 509.

Each of the recording heads 509 comprises an exchangeable cartridge having an ink tank which is integrated therewith. The recording material 505 is intermittently fed for the recording width (height for one line) of the recording heads 509 in the direction of arrow f (vertical scanning). During the time the recording material 5 is stopped, the carriage 508 is moved in the direction of arrow P, an d recording is performed by discharging ink from each of the recording heads 509 on the basis of an image signal synchronously with movement (horizontal scanning) o f the carriage 508. Namely, the whole image is recorded by alternately repeating vertical scanning and horizontal scanning of the recording material 505.

FIG. 15 is a block diagram of the image recording apparatus of this embodiment.

In FIG. 15, reference numeral 521 denotes an input image signal; reference numeral 522, a buffer memory; reference numeral 523, decision means; reference numeral 524, a γ-control signal; reference numeral 525, a γ-conversion unit; reference numeral 526, a scan control signal; reference numeral 527, a scan control unit; reference numeral 528, a signal for driving a horizontal scanning motor; reference numeral 529, a signal for driving a vertical scanning motor; reference numeral 530, the horizontal scanning motor; reference numeral 531, the vertical scanning motor; reference numeral 532, a converted signal; reference numeral 533, a head driving circuit; reference numeral 534, a head driving signal; reference numeral 535, a recording head; reference numeral 536, select means; and reference numeral 537, a select signal.

The input image signal 521 is stored in the buffer memory 522 serving as image memory for one scan, and then transmitted to the decision means 523.

When the value of the scan control signal 526 is "0", like in a normal case, the scan control unit 527 controls the horizontal scanning motor 530 and the vertical scanning motor 531 so as to perform vertical scanning after one horizontal scanning. When the value of the scanning control signal 526 is "1", each of the motors 530 and 531 is controlled so as to perform one vertical scanning after two horizontal scanning operations in accordance with the image data stored in the buffer memory 522. The driving circuit 533 receives the image signal subjected to γ-conversion, and outputs driving pulses 534 to the recording head 535. The recording head 535 discharges ink droplets in accordance with the driving pulses 534 to record an image on the recording material 505 by the ink droplets.

When the reflection mode is selected, as described below, the γ-conversion table having values which may be graphed as line A shown in FIG. 16 is used for recording an image by one scan, as in the normal case.

The select means 536 is adapted for selecting one of the transmission mode and the reflection mode, and the user can select one of the two recording modes by operating external select switches of the image recording apparatus. The select signal 537 is transmitted as a mode selection signal to the decision means 523

(Recording operation in reflection mode) When the reflection mode is selected, it is unnecessary to increase the recording density, as compared with the transmission mode. In this case, the decision means 523 outputs a value "0" as the γ-control signal 524 and the scanning control signal 526. The γ-conversion unit 525 is a table ROM for performing γ-conversion by using different conversion tables in accordance with the values of the γ-conversion signal 524. When the value of the γ-control signal 524 is "0", the contents of the conversion characteristic table are graphically depicted by line A in FIG. 16 (referred to as "table A" hereinafter) is selected. When the value of the γ-control signal is "1", the contents of the conversion characteristic table are graphically depicted by line B in FIG. 16 (referred to as "table B" hereinafter) is selected.

(Recording operation in transmission mode)

When the transmission mode is selected, the image data for one scan is monitored by the decision means 523, and a control signal corresponding to the monitor result is output. Namely, the decision means 523 decides whether or not there is data having a value of "128" or more in the image data for one line which is stored in the buffer memory, i.e., whether or not there is data having a value of "128" or more in data having values corresponding to the recording densities of respective pixels in one line. If there is no data having a value of "128" or more, the value of the γ-control signal 524 is set to "1", and the value of the scanning control signal is set to "0". In this case, therefore, the γ-conversion table B is used for recording an image by one scan. The maximum value of the image data is "255".

If there is data having a value of "128" or more in the image data for one line, the value of the γ-control signal is set to "0", and the value of the scanning control signal is set to "1". In this case, therefore, the γ-conversion table A is used for recording an image by two scans.

When a double recording density can be obtained only by switching the γ-conversion table A to B, i.e., when there is no data having a value of "128" or more in image data for one line, the γ-conversion table is switched (switched to table B), without two times of injection of ink droplets by two scans. When a double recording density cannot be obtained unless two times of injection of ink droplets are performed by two scans, i.e., when there is data having a value of "128" or more in the image data for one line, injection of ink droplets is performed twice by two scans without switching the γ-conversion table A. As a result, the recording operation for an OHP film used for the transmission type overhead projector can be carried out within the minimum necessary time, and a sufficient recording density can be obtained.

Sixth Embodiment

This embodiment is constructed so that the γ-conversion table can be switched in accordance with the quantity of light of a light source for the overhead projector, i.e., in accordance with "brightness" of the light source. Namely, recording modes for the case of a relatively bright light source and the case of a relatively dark light source are provided for each of the reflection and transmission modes.

The block diagram of this embodiment is the same as FIG. 15 except that the select means 536 is configured so that four steps of (1) "dark reflection mode", (2) "bright reflection mode", (3) "dark transmission mode" and (4) "bright transmission mode" can be switched. The γ-conversion unit 525 is provided with six γ-conversion tables of the conversion characteristics whose contents may be graphically depicted by lines C, D, E, F, F, and H shown in FIG. 17 (referred to as "tables C, D, E, F, G and G" hereinafter). The tables C, D, E and F are conversion tables for setting the maximum output value "255" when the values of the 8-bit input signal (image data) are "255", "212", "170" are "128", respectively.

The tables G and H are conversion tables for setting the output values of tables E and D to a value of double the output thereof within a range where the double value of the output is less than the maximum value "255".

When (1) "dark reflection mode" is selected, i.e., when recording is performed on the recording material 505 for a reflection type overhead projector using a relatively dark light source, conversion table C is selected and used for recording an image by one scan.

When (2) "bright reflection mode" is selected, i.e, when recording is performed on the recording material 505 for a reflection type overhead projector using a relatively bright light source, it is decided by the decision means whether or not there is data having a value of "212" or more in the image data for one scan. If there is no data having a value of "212" or more, table D is selected and used for recording an image by one scan. On the other hand, if there is data having a value of "212" or more, table H is selected and used for recording an image by two scans.

When (3) "dark transmission mode" is selected, i..e., when recording is performed on the recording material 505 for a transmission type overhead projector using a relatively dark light source, decision is made as to whether or not there is data having a value of "170" or more in the image data of one scan. If the image data contains no data having a value of "170" or more, table E is selected and used for recording an image by one scan. On the other hand, if the image data contains data having a value of "170" or more, table G is selected and used for recording an image by two scans.

When (4) "bright transmission mode" is selected, i.e., when recording is performed on the recording material 505 for a transmission type overhead projector using a relatively bright light source, recording is carried out in the same manner as the fifth embodiment. Tables C and F in this embodiment correspond to tables A and B, respectively, in the fifth embodiment.

In this way, this embodiment is constructed so that a recording mode can be selected from a plurality of modes in accordance with the quantity of light of the projector used, thereby permitting finer adjustment of the recording density.

Seventh Embodiment

In this embodiment, the γ-conversion tables are switched in accordance with the distance between the OHP sheet used as the recording material 505 and a screen in projection by a projector.

Namely, since the density of the projected image is generally decreased as the distance between the recording material 505 and the screen is increased, a decrease in image density is corrected in this embodiment.

Figure 17:
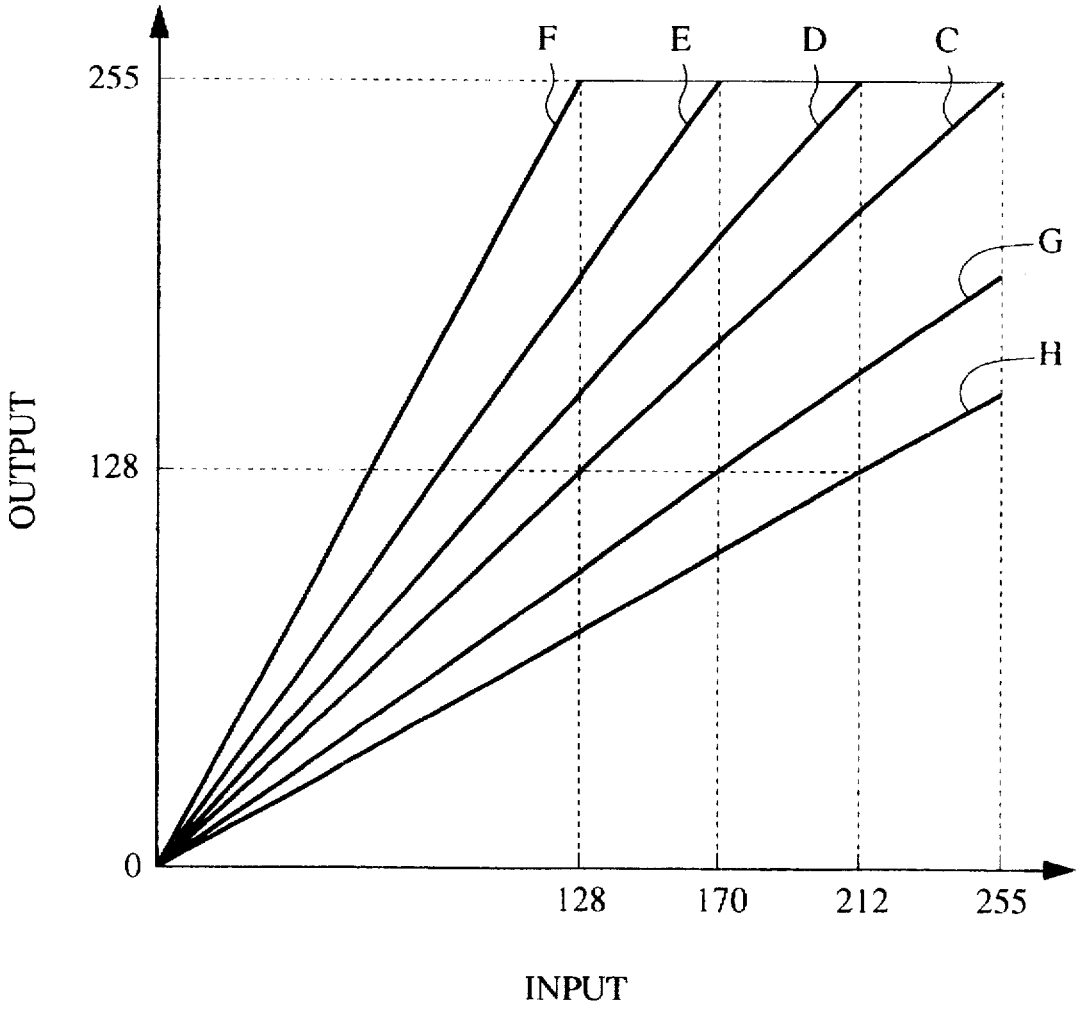

In this embodiment, one of four modes including (1) "near reflection mode", (2) "distant reflection mode", (3) "near transmission mode" and (4) "distant transmission mode" is selected in each of the reflection and transmission modes in accordance with the distance. The same γ-conversing tables as those shown in FIG. 17 are provided so that one of the γ-conversion tables and one-scan recording or two-scan recording are selected in accordance with the recording mode selected and the result of decision on the image data for one scan, as in the above sixth embodiment.

Although each of the above fifth, sixth and seventh embodiments relates to an ink jet recording apparatus, the present invention can also be applied to a recording apparatus in other recording systems such as sublimation type heat transfer, melting type heat transfer, etc.

Others

Although each of the above embodiments relates to the case where recording conditions for the recording material such as the OHP sheet or the like are changed, the recording modes for the OHP sheet may be added to the recording mode for a recording material such as ordinary paper or the like. In the recording mode of paper, sufficient colors can be obtained with a recording density lower than the recording density in the reflection mode.

Particularly, the present invention exhibits excellent effects on a recording head and a recording apparatus in an ink jet recording system which is provided with means (for example, an electro-thermal converter or a laser beam) for generating heat energy as energy utilized for discharging ink, and the state of the ink is changed by the heat energy. This is because such a system can achieve high-density and high-definition recording.

It is preferable to use the basic principle disclosed in, for example, U.S. Pat. Nos. 4,723,129 and 4,740,796. This system can be applied to a so-called on-demand type or continuous type apparatus. In particular, the on-demand type is effective because heat energy is generated in an electro-thermal converter which is disposed opposite to a sheet containing a liquid (ink) and a liquid passage by applying, to the electro-thermal converter, at least one driving signal for rapidly increasing the temperature above the temperature of nuclear boiling in correspondence with recording information to produce film boiling in the thermal action surface of the recording head. As a result, bubbles are formed in the liquid (ink) in one-to-one correspondence with the driving signal. The liquid (ink) is discharged from a discharge opening due to the growth and contraction of the bubble to form at least one droplet. The driving signal in a pulse form is more preferable because the bubble is instantaneously and appropriately grown and contracted, thereby achieving discharge of the liquid (ink) with excellent responsibility. The driving signals disclosed in U.S. Pat. Nos. 4,463,359 and 4,345,262 are suitable as such pulse-formed driving signals. More excellent recording can be performed by employing the conditions disclosed in the invention of U.S. Pat. No. 4,313,124 which relates to the rate of temperature rise of the thermal action surface.

The present invention includes not only the structure of the recording head comprising the combination of a discharge opening, a liquid passage (a linear liquid passage or a right angle liquid passage) and an electro-thermal converter, as disclosed in each of the above specifications, but also the structures disclosed in U.S. Pat. Nos. 4,558,333 and 4,459,600 in which a thermal action portion is disposed in a bent region. The present invention is also effective for structures based on the structure disclosed in Japanese Patent Laid-Open No. 59-123670 in which a common slit is provided as a discharge portion for a plurality of electro-thermal converters, and the structure disclosed in Japanese Patent Laid-Open No. 59-138461 in which an opening for absorbing the pressure wave of thermal energy is provided opposite to a discharge portion. This is because the present invention can securely efficiently record images by a recording head having any form.

Further, the present invention can effectively be applied to a full-line type recording head having a length corresponding to the maximum width of recording media on which the recording apparatus can record images. Such a recording head may comprise a combination of a plurality of recording heads which satisfy the length of the recording head, or a single recording head which is integrally formed.

Although the present invention is effective for the use of the above serial type of recording head, such a recording head may be a type which is fixed to the apparatus body, a exchangeable chip type which permits electrical connection to the apparatus body and supply of ink from the apparatus body when being mounted thereon, or a cartridge type having an ink tank which is provided integrally with the recording head.

It is also preferable to add as components discharge recovery means for the recording head, preliminary auxiliary means and the like to the recording apparatus of the present invention because the effects of the invention can further be stabilized. Examples of such means include capping means for the recording head, cleaning means, pressure or suction means, preheating means for heating by using an electro-thermal converter or another heating element or a combination thereof, and pre-discharge means for discharging ink separately from recording.

In regard to the type and the number of recording heads mounted, for example, only one recording head may be provided corresponding to a single color ink, or a plurality of recording heads may be provided corresponding to a plurality of inks having different recording colors and densities. Namely, the present invention is significantly effective for not only a recording apparatus having a recording mode only for a main color such as black or the like but also a recording apparatus having at least one of full-color recording mode for a plurality of different colors and color mixture whether the apparatus comprises an integral recording head or combination of a plurality of heads.

Although each of the above embodiments of the present invention uses a liquid ink, ink which is solidified at room temperature or lower and softened or liquefied at room temperature may be used, or ink which is liquid at the time of application of the recording signal may be used because, in an ink jet system, the temperature of the ink itself is generally controlled within the range of 30° to 70° C. so that the viscosity thereof is within a stable discharge range. An ink which is solidified by allowing it to stand and liquefied by heating may also be used for positively preventing a temperature rise due to thermal energy by using the thermal energy as energy for changing a solid state of the ink to a liquid state thereof, or preventing evaporation of the ink. In any cases, the present invention can also be applied to the use of an ink having the property that it is not liquefied until thermal energy is applied, such as an ink which is liquefied by applying thermal energy corresponding to the recording signal and is discharged in a liquid state, an ink which has already started to solidify when reaching a recording medium, or the like. Such inks may be held in a liquid or solid state in recesses or through holes in a porous sheet opposite to the electro-thermal converter. In the present invention, the above film boiling system is most effective for each of the above inks .

The ink jet recording apparatus of the present invention may be an apparatus which is used as an image output terminal of an information processing apparatus such as a computer, a copying apparatus combined with a reader, or a facsimile apparatus having the transmission and receiving function.

As described above, in accordance with the first aspect of the invention, the image recording apparatus is capable of recording high-quality images suitable for the type and application of the recording material used by changing the number of recording operations within the same recording area of various types recording materials used for different applications, such as recording materials used for a reflection type or transmission type overhead projector.

When a plurality of recording operations are carried out within the same recording area, a predetermined waiting time is set between the respective recording operations so that a recording agent such as ink can securely be fixed to a recording material.

When a plurality of recording operations are carried out within the same recording area, recording conditions (e.g., recording density) of the recording operations are different from each other so that a high-quality image can be recorded on a recording material having the property that a recording agent such as ink is not sufficiently fixed thereto.

The image data output from the means for reading an original image is recorded in the storage means so that when a plurality of recording operations are carried out within the same recording area, without an increase in the number of the reading operations by the reading means, the durability of the movable portion of the reading means can be improved.

In accordance with the second aspect of the present invention, the image recording apparatus is capable of recording a high-quality image suitable of the type and application of the recording material used by changing the density of the recorded image.

The recording density and the number of recording operations for the same recording area are changed in accordance with the value corresponding to the recording density of image data so that optimum recording conditions can automatically be obtained.

What is claimed is:

1. An image recording apparatus comprising:

recording means for recording an image on a recording material based on image data;

movement means for moving said recording means relative to the recording material;

recording mode setting means for setting a first recording mode for a transmission type overhead projector and a second recording mode for a reflection type overhead projector; and recording control means for changing a number of times said recording means is moved relative to a same area of said recording material by said movement means based on the set recording mode, and for changing a number of recording operations within the same area, wherein said recording control means controls the recording means to make the number of recording operations within the same area in the first recording mode more than in the second recording mode.

2. An image recording apparatus according to claim 1, further comprising setting means for setting predetermined waiting periods between respective recording operations when a plurality of recording operations are carried out within the same recording area of said recording material.

3. An image recording apparatus according to claim 1, further comprising switching means for switching recording conditions of respective recording operations when a plurality of recording operations are carried out within the same recording area of said recording material.

4. An image recording apparatus according to claim 3, further comprising density control means for controlling a density of the image recorded by said recording means, wherein said switching means switches densities of the images recorded by respective recording operations.

5. An image recording apparatus according to claim 1, further comprising reading means for reading an original image, and means for supplying the image read by said reading means as image data to said recording means.

6. An image recording apparatus according to claim 5, further comprising storage means for storing data of the image read by said reading means, wherein said recording control means performs one or more recording operations based on the image data stored in said storage means.

7. An image recording apparatus according to claim 1, wherein said recording means includes a discharge opening for discharging ink therefrom and discharge means for discharging ink from said discharge opening.

8. An image recording apparatus according to claim 7, wherein said discharge means is heat energy generating means for applying heat energy to ink so that the state of ink is changed by applying heat energy to discharge ink from said discharge opening based on the state change.

9. An image recording method in an image recording apparatus having recording means for recording an image on a recording material based on image data, said method comprising steps of:

setting a recording mode from a plurality of recording modes, the plurality of recording modes including a first recording mode for a transmission type overhead projector and a second recording mode for a reflection type overhead projector;

controlling recording by changing a number of recording operations within a recording area of the recording material by the recording means based on the recording mode set in said setting step; and recording by changing a number of times the recording means is moved relative to a same area on the recording material based on a number of recording operations set in said recording control step, so that in the first recording mode the number of recording operations within the same area of the recording material is more than in the second recording mode.

10. An image recording apparatus comprising:

recording means for recording an image on a recording material based on image data, said recording means recording an image in accordance with a recording image density indicated by the image data;

control means for changing recording image data indicated by the image data by controlling said recording means; and recording control means for changing a number of recording scanning operations performed within a recording area of the recording material by said recording means.

11. An image recording apparatus according to claim 10, wherein when recording is performed with a high recording image density, and when the image data indicates the recording image density is higher than a predetermined recording image density, the number of recording operations within the recording areas of the recording material is increased by said control means without changing the recording image density.

12. An image recording apparatus according to claim 10, wherein when recording is performed with a high recording image density, and when the image data indicates the recording image density is lower than a predetermined recording image density, recording is performed by said control means with an increased recorded image density.

13. An image recording apparatus according to claim 10, wherein said recording means comprises a discharge opening for discharging ink therefrom and discharge means for discharging ink from said discharge opening.

14. An image recording apparatus according to claim 13, wherein when said discharge means is heat energy generating means for applying heat energy to ink so that a state of the ink is changed by applying heat energy to discharge the ink from said discharge opening based on the state change.

15. An image recording apparatus comprising:

recording means for recording an image on a recording material based on image data;

a first recording mode for recording on the recording material used for projection using transmitted light suitable for a projection device with a relatively high projection density;

a second recording mode for recording on the recording material used for projection using transmitted light suitable for a projection device with a relatively low projection density; and recording control means for changing the density of the image recorded by said recording means in accordance with said first and second recording mode by changing a number of recording scanning operations within a recording area.

16. An image recording apparatus according to claim 15, wherein said recording control means makes the recorded image density in said second recording mode higher in said first recording mode.

17. An image recording apparatus according to claim 15, further comprising means for specifying recording in one of said first and second recording mode.

18. An image recording apparatus according to claim 15, wherein said recording control means performs one or more recording operations within said recording area of said recording material by said recording means in said second recording mode.

19. An image recording apparatus according to claim 15, wherein said recording comprises a discharge opening for discharging ink therefrom and discharge means for discharging ink from said discharge opening.

20. An image recording apparatus according to claim 19, wherein said discharge means is heat energy generating means for applying heat energy to ink so that a state of ink is changed by applying heat energy to discharge the ink from said discharge opening based on the state change.

* * * * *

UNITED STATES PATENT AND TRADEMARK OFFICE

CERTIFICATE OF CORRECTION

PATENT NO. : 5,790,143

DATED : August 4, 1998

INVENTOR(S) : Takada et al.

It is certified that error appears in the above-identified patent and that said Letters Patent is hereby corrected as shown below:

COLUMN 1:

Line 4, "THEREFORE" should read --THEREFOR--.

COLUMN 2:

Line 9, "by" should be deleted; and
Line 62, "trough" should read --through--.

COLUMN 6:

Line 10, "occur" should read --occurs--.

COLUMN 7:

Line 58, "recording" should read --record--.

COLUMN 9:

Line 61, "$(Q_{max}>Q'_{max})$" should read --$(Q_{max}>Q'_{max})$.--.

UNITED STATES PATENT AND TRADEMARK OFFICE

CERTIFICATE OF CORRECTION

PATENT NO. : 5,790,143

DATED : August 4, 1998

INVENTOR(S) : Takada et al.

It is certified that error appears in the above-identified patent and that said Letters Patent is hereby corrected as shown below:

COLUMN 11:

Line 20, "an d" should read --and--;
Line 23, "o f" should read --of--; and
Line 41, "535." should read --535,--.

COLUMN 12:

Line 5, after "mode)", begin a new paragraph with "When".

COLUMN 13:

Line 4, "F, F, and H" should read --F, G, and H--;
Line 5, "F, G and G" should read --F, G and H--;
Line 30, "i..e.," should read --i.e.,--; and
Line 66, "γ-conversing" should read --γ-conversion--.

COLUMN 15:

Line 13, "a" (second occurrence) should read --an--.

UNITED STATES PATENT AND TRADEMARK OFFICE

CERTIFICATE OF CORRECTION

PATENT NO. : 5,790,143

DATED : August 4, 1998

INVENTOR(S) : Takada et al.

It is certified that error appears in the above-identified patent and that said Letters Patent is hereby corrected as shown below:

COLUMN 18:

Line 4, "areas" should read --area--;
Line 17, "when" should be deleted;
Line 44, "mode." should read --modes.--; and
Line 51, "recording" should read --recording means--.

Signed and Sealed this

Twenty-fifth Day of May, 1999

*Attest:*

*Attesting Officer*

Q. TODD DICKINSON

*Acting Commissioner of Patents and Trademarks*